US008414085B2

(12) United States Patent
Hall et al.

(10) Patent No.: US 8,414,085 B2
(45) **Date of Patent: *Apr. 9, 2013**

(54) SHANK ASSEMBLY WITH A TENSIONED ELEMENT

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 646 days.

This patent is subject to a terminal disclaimer.

(21) Appl. No.: 12/020,924

(22) Filed: Jan. 28, 2008

(65) Prior Publication Data

US 2008/0115978 A1 May 22, 2008

Related U.S. Application Data

(63) Continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, (Continued)

(51) Int. Cl.
*E21C 35/19* (2006.01)

(52) U.S. Cl.
USPC ..... 299/113

(58) Field of Classification Search ..... 299/100–111, 299/112 R, 112 T, 113, 95
See application file for complete search history.

(56) References Cited

U.S. PATENT DOCUMENTS 2,004,315 A 6/1935 Fean
2,040,263 A * 5/1936 Layne et al. ..... 175/421

(Continued)

FOREIGN PATENT DOCUMENTS

DE 3307910 A1 9/1984
DE 3431495 A1 3/1986

(Continued)

OTHER PUBLICATIONS

Kennametal Inc. Catalog, entitled "Construction Tools," pp. 1-20 (1997).

*Primary Examiner* — Sunil Singh
(74) *Attorney, Agent, or Firm* — Brinks Hofer Gilson & Lione

(57) ABSTRACT

In one aspect of the invention, a tool comprises a head and a shank assembly. The shank assembly has a tensioned element axially disposed within a bore of a structural element and a distal end of the tensioned element is secured within or below the bore. The head has a cavity formed in its base end and is adapted to receive a proximal end of the tensioned element. The tensioned element has a radially extending catch adapted to interlock within the cavity of the head. The head is harder than the tensioned element.

16 Claims, 17 Drawing Sheets

Related U.S. Application Data filed on Aug. 11, 2006, now Pat. No. 7,338,135, which is a continuation-in-part of application No. 11/463, 998, filed on Aug. 11, 2006, now Pat. No. 7,384,105, which is a continuation-in-part of application No. 11/463,990, filed on Aug. 11, 2006, now Pat. No. 7, 320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, said application No. 11/971,965 is a continuation-in-part of application No. 11/695,672, filed on Apr. 3, 2007, now Pat. No. 7,396, 086, which is a continuation-in-part of application No. 11/686,831, filed on Mar. 15, 2007, now Pat. No. 7, 568,770.

(56) References Cited

U.S. PATENT DOCUMENTS

| | | | | | |
|---|---|---|---|---|---|
| 2,124,438 | A | | 7/1936 | Struk | |
| 2,972,713 | A | | 2/1961 | Sutton, Jr. | |
| 3,089,215 | A | | 5/1963 | Stubbs | |
| 3,254,392 | A | | 6/1966 | Novkov | |
| 3,268,259 | A | | 8/1966 | Arthur | |
| 3,342,531 | A | | 9/1967 | Krekeler | |
| 3,342,532 | A | | 9/1967 | Krekeler | |
| 3,397,012 | A | | 8/1968 | Krekeler | |
| 3,512,838 | A | | 5/1970 | Kniff | |
| 3,519,309 | A | | 7/1970 | Engle | |
| 3,650,565 | A | | 3/1972 | Kniff | |
| 3,655,244 | A | | 4/1972 | Swisher | |
| 3,746,396 | A | | 7/1973 | Radd | |
| 3,767,266 | A | | 10/1973 | Krekeler | |
| 3,807,804 | A | | 4/1974 | Kniff | |
| 3,830,321 | A | | 8/1974 | McKenry | |
| 3,932,952 | A | | 1/1976 | Helton | |
| 3,942,838 | A | | 3/1976 | Bailey et al. | |
| 3,945,681 | A | | 3/1976 | White | |
| 3,957,307 | A | | 5/1976 | Varda | |
| 4,005,914 | A | | 2/1977 | Newman | |
| 4,006,936 | A | | 2/1977 | Crabiel | |
| 4,076,318 | A | * | 2/1978 | Hauschopp et al. | 299/103 |
| 4,098,362 | A | | 7/1978 | Bonnice | |
| 4,109,737 | A | | 8/1978 | Bovenkerk | |
| RE29,900 | E | | 2/1979 | Kniff | |
| 4,149,753 | A | | 4/1979 | Stoltz et al. | |
| 4,156,329 | A | | 5/1979 | Daniels | |
| 4,199,035 | A | | 4/1980 | Thompson | |
| 4,201,421 | A | | 5/1980 | Den Besten | |
| 4,247,150 | A | | 1/1981 | Wrulich et al. | |
| 4,268,089 | A | | 5/1981 | Spence | |
| 4,277,106 | A | | 7/1981 | Sahley | |
| 4,397,362 | A | | 8/1983 | Dice et al. | |
| 4,439,250 | A | | 3/1984 | Acharya | |
| 4,443,038 | A | | 4/1984 | Brown | |
| 4,465,221 | A | | 8/1984 | Schmidt | |
| 4,484,644 | A | | 11/1984 | Cook | |
| 4,484,783 | A | | 11/1984 | Emmerich | |
| 4,489,986 | A | | 12/1984 | Dziak | |
| 4,497,520 | A | | 2/1985 | Ojanen | |
| 4,537,448 | A | | 8/1985 | Ketterer | |
| 4,542,942 | A | | 9/1985 | Zitz et al. | |
| 4,583,786 | A | | 4/1986 | Thorpe et al. | |
| 4,627,665 | A | | 12/1986 | Ewing | |
| 4,660,890 | A | | 4/1987 | Mills | |
| 4,669,786 | A | | 6/1987 | Morgan et al. | |
| 4,678,237 | A | | 7/1987 | Collin | |
| 4,682,987 | A | | 7/1987 | Brady | |
| 4,684,176 | A | | 8/1987 | Den Besten | |
| 4,688,856 | A | | 8/1987 | Elfgen | |
| 4,694,918 | A | | 9/1987 | Hall | |
| 4,702,525 | A | | 10/1987 | Sollami | |
| 4,713,897 | A | * | 12/1987 | Hemphill | 37/454 |
| 4,725,098 | A | | 2/1988 | Beach | |
| 4,728,153 | A | | 3/1988 | Ojanen | |
| 4,729,603 | A | | 3/1988 | Elfgen | |
| 4,736,533 | A | | 4/1988 | May et al. | |
| 4,746,379 | A | | 5/1988 | Rabinkin | |
| 4,765,686 | A | | 8/1988 | Adams | |
| 4,765,687 | A | | 8/1988 | Parrott | |
| 4,776,862 | A | | 10/1988 | Wiand | |
| 4,798,026 | A | | 1/1989 | Cerceau | |
| 4,804,231 | A | | 2/1989 | Buljan et al. | |
| 4,811,801 | A | | 3/1989 | Salesky et al. | |
| 4,828,327 | A | * | 5/1989 | Wechner | 299/102 |
| 4,836,614 | A | | 6/1989 | Ojanen | |
| 4,850,649 | A | | 7/1989 | Beach et al. | |
| 4,880,154 | A | | 11/1989 | Tank | |
| 4,893,875 | A | | 1/1990 | Lonn | |
| 4,921,310 | A | | 5/1990 | Hedlund et al. | |
| D308,683 | S | | 6/1990 | Meyers | |
| 4,932,723 | A | | 6/1990 | Mills | |
| 4,940,288 | A | | 7/1990 | Stiffler | |
| 4,944,559 | A | | 7/1990 | Sionnet | |
| 4,951,762 | A | | 8/1990 | Lundell | |
| 4,956,238 | A | | 9/1990 | Griffin | |
| 5,007,685 | A | | 4/1991 | Beach et al. | |
| 5,011,515 | A | | 4/1991 | Frushour | |
| 5,018,793 | A | | 5/1991 | Den Besten | |
| 5,098,167 | A | | 3/1992 | Latham | |
| 5,106,166 | A | | 4/1992 | O'Neill | |
| 5,112,165 | A | | 5/1992 | Hedlund | |
| 5,119,714 | A | | 6/1992 | Scott | |
| 5,141,289 | A | | 8/1992 | Stiffler | |
| 5,154,245 | A | | 10/1992 | Waldenstrom | |
| 5,186,892 | A | | 2/1993 | Pope | |
| 5,251,964 | A | | 10/1993 | Ojanen | |
| 5,261,499 | A | | 11/1993 | Grubb | |
| 5,303,984 | A | | 4/1994 | Ojanen | |
| 5,332,348 | A | | 7/1994 | Lemelson | |
| 5,333,938 | A | * | 8/1994 | Gale | 299/106 |
| 5,374,111 | A | | 12/1994 | Den Besten | |
| 5,415,462 | A | | 5/1995 | Massa | |
| 5,417,475 | A | | 5/1995 | Graham | |
| 5,447,208 | A | | 9/1995 | Lund | |
| 5,494,477 | A | | 2/1996 | Flood et al. | |
| 5,503,463 | A | | 4/1996 | Ojanen | |
| 5,535,839 | A | | 7/1996 | Brady | |
| 5,542,993 | A | | 8/1996 | Rabinkin | |
| 5,653,300 | A | | 8/1997 | Lund | |
| 5,662,720 | A | | 9/1997 | O'Tighearnaigh | |
| 5,713,412 | A | | 2/1998 | Wepfer | |
| 5,720,528 | A | | 2/1998 | Ritchey | |
| 5,725,283 | A | | 3/1998 | O'Neill | |
| 5,730,502 | A | | 3/1998 | Montgomery, Jr. | |
| 5,738,415 | A | | 4/1998 | Parrott | |
| 5,738,698 | A | | 4/1998 | Kapoor | |
| 5,823,632 | A | | 10/1998 | Burkett | |
| 5,837,071 | A | | 11/1998 | Andersson et al. | |
| 5,842,747 | A | | 12/1998 | Winchester | |
| 5,845,547 | A | | 12/1998 | Sollami | |
| 5,875,862 | A | | 3/1999 | Jurewicz | |
| 5,884,979 | A | | 3/1999 | Latham | |
| 5,890,552 | A | | 4/1999 | Scott et al. | |
| 5,934,542 | A | | 8/1999 | Nakamura | |
| 5,935,718 | A | | 8/1999 | Demo | |
| 5,944,129 | A | | 8/1999 | Jenson | |
| 5,967,250 | A | | 10/1999 | Lund | |
| 5,992,405 | A | | 11/1999 | Sollami | |
| 6,000,483 | A | | 12/1999 | Jurewicz et al. | |
| 6,006,846 | A | | 12/1999 | Tibbitts | |
| 6,019,434 | A | | 2/2000 | Emmerich | |
| 6,044,920 | A | | 4/2000 | Massa | |
| 6,051,079 | A | | 4/2000 | Andersson | |
| 6,056,911 | A | | 5/2000 | Griffin | |
| 6,065,552 | A | | 5/2000 | Scott | |
| 6,099,081 | A | | 8/2000 | Warren | |
| 6,102,486 | A | | 8/2000 | Briese | |
| 6,113,195 | A | | 9/2000 | Mercier | |
| 6,170,917 | B1 | | 1/2001 | Heinrich | |
| 6,193,770 | B1 | | 2/2001 | Sung | |
| 6,196,636 | B1 | | 3/2001 | Mills | |
| 6,196,910 | B1 | | 3/2001 | Johnson | |

| | | | |
|---|---|---|---|
| 6,199,956 | B1 | 3/2001 | Kammerer |
| 6,216,805 | B1 | 4/2001 | Lays |
| 6,270,165 | B1 | 8/2001 | Peay |
| 6,341,823 | B1 | 1/2002 | Sollami |
| 6,354,771 | B1 | 3/2002 | Bauschulte |
| 6,357,832 | B1 | 3/2002 | Sollami |
| 6,364,420 | B1 | 4/2002 | Sollami |
| 6,371,567 | B1 | 4/2002 | Sollami |
| 6,375,272 | B1 | 4/2002 | Ojanen |
| 6,419,278 | B1 | 7/2002 | Cunningham |
| 6,460,637 | B1 | 10/2002 | Siracki et al. |
| 6,478,383 | B1 | 11/2002 | Ojanen |
| 6,481,803 | B2 | 11/2002 | Ritchey |
| 6,499,547 | B2 | 12/2002 | Scott |
| 6,508,516 | B1 | 1/2003 | Kammerer |
| 6,517,902 | B2 | 2/2003 | Drake |
| RE38,151 | E | 6/2003 | Penkunas |
| 6,585,326 | B2 | 7/2003 | Sollami |
| 6,585,327 | B2 | 7/2003 | Sollami |
| 6,601,662 | B2 | 8/2003 | Matthias et al. |
| 6,644,755 | B1 | 11/2003 | Kammerer |
| 6,651,758 | B2 | 11/2003 | Xiang et al. |
| 6,659,206 | B2 | 12/2003 | Liang et al. |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,719,074 | B2 | 4/2004 | Tsuda et al. |
| 6,732,914 | B2 | 5/2004 | Cadden et al. |
| 6,733,087 | B2 | 5/2004 | Hall |
| 6,739,327 | B2 | 5/2004 | Sollami |
| 6,758,530 | B2 | 7/2004 | Sollami |
| 6,786,557 | B2 | 9/2004 | Montgomery, Jr. |
| 6,824,225 | B2 | 11/2004 | Stiffler |
| 6,851,758 | B2 | 2/2005 | Beach |
| 6,854,810 | B2 | 2/2005 | Montgomery, Jr. |
| 6,861,137 | B2 | 3/2005 | Griffin |
| 6,863,352 | B2 | 3/2005 | Sollami |
| 6,880,744 | B2 | 4/2005 | Noro et al. |
| 6,889,890 | B2 | 5/2005 | Yamazaki |
| 6,938,961 | B2 | 9/2005 | Broom |
| 6,962,395 | B2 | 11/2005 | Mouthaan |
| 6,966,611 | B1 | 11/2005 | Sollami |
| 6,994,404 | B1 | 2/2006 | Sollami |
| 7,094,473 | B2 | 8/2006 | Takayama et al. |
| 7,204,560 | B2 | 4/2007 | Mercier |
| 7,234,782 | B2 | 6/2007 | Stehney |
| 7,369,743 | B2 | 5/2008 | Watkins et al. |
| 7,380,888 | B2 | 6/2008 | Ojanen |
| 7,384,105 | B2 | 6/2008 | Hall et al. |
| 7,387,345 | B2 | 6/2008 | Hall et al. |
| 7,390,066 | B2 | 6/2008 | Hall et al. |
| 7,413,258 | B2 | 8/2008 | Hall et al. |
| 7,963,617 | B2 * | 6/2011 | Hall et al. ..... 299/113 |
| 2002/0070602 | A1 | 6/2002 | Sollami |
| 2002/0153175 | A1 | 10/2002 | Ojanen |
| 2002/0175555 | A1 | 11/2002 | Mercier |
| 2003/0015907 | A1 | 1/2003 | Sollami |
| 2003/0047985 | A1 | 3/2003 | Stiffler |
| 2003/0137185 | A1 | 7/2003 | Sollami |
| 2003/0141350 | A1 | 7/2003 | Noro et al. |
| 2003/0141753 | A1 | 7/2003 | Peay et al. |
| 2003/0209366 | A1 | 11/2003 | McAlvain |
| 2003/0230926 | A1 | 12/2003 | Mondy |
| 2003/0234280 | A1 | 12/2003 | Cadden |
| 2004/0026983 | A1 | 2/2004 | McAlvain |
| 2004/0065484 | A1 | 4/2004 | McAlvain |
| 2005/0044987 | A1 | 3/2005 | Takayama |
| 2005/0159840 | A1 | 7/2005 | Lin |
| 2005/0173966 | A1 | 8/2005 | Mouthaan |
| 2006/0125306 | A1 | 6/2006 | Sollami |
| 2006/0237236 | A1 | 10/2006 | Sreshta |
| 2006/0261663 | A1 | 11/2006 | Sollami |

FOREIGN PATENT DOCUMENTS

| | | | |
|---|---|---|---|
| DE | 3500261 | | 7/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | | 6/1988 |
| EP | 0412287 | | 2/1991 |
| EP | 899051 | A1 | 10/2001 |
| EP | 1186744 | A3 | 9/2003 |
| EP | 1574309 | A1 | 9/2005 |
| GB | 2004315 | | 3/1979 |
| GB | 2037223 | | 11/1979 |
| JP | 5 280 273 | | 10/1993 |
| JP | 3123193 | | 1/2001 |
| JP | 2002-81524 | A | 3/2002 |

* cited by examiner

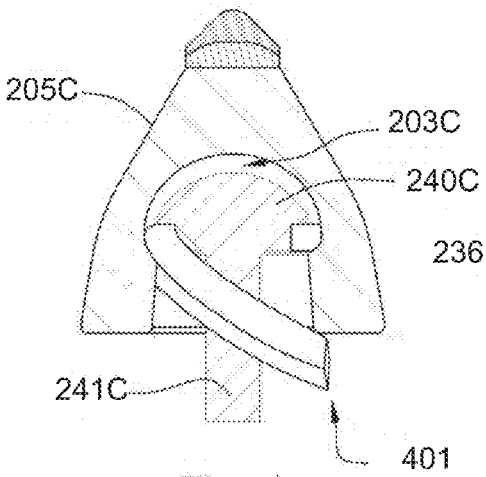
Fig. 4
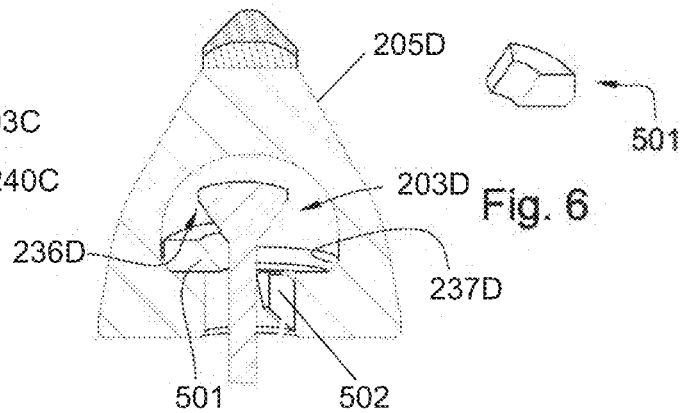
Fig. 6
Fig. 5
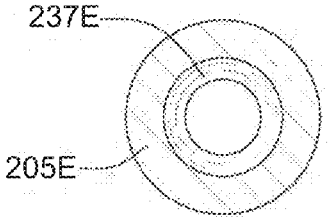
Fig. 7
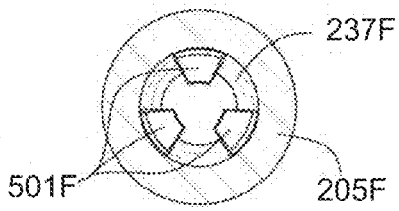
Fig. 8
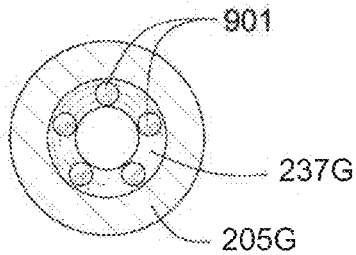
Fig. 9
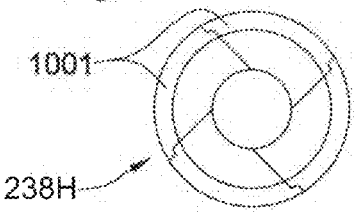
Fig. 10
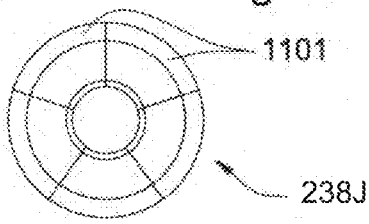
Fig. 11
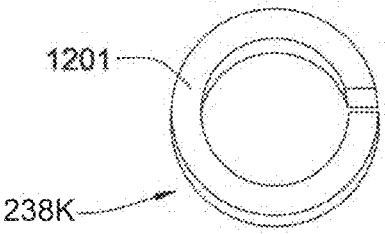
Fig. 12
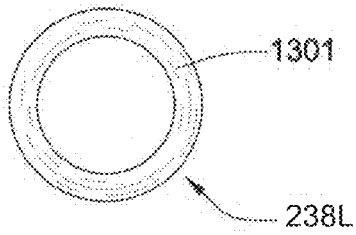
Fig. 13

SHANK ASSEMBLY WITH A TENSIONED ELEMENT

CROSS REFERENCE TO RELATED APPLICATIONS

This application is a continuation-in-part of U.S. patent application Ser. No. 11/971,965 filed on Jan. 10, 2008 and now U.S. Pat. No. 7,648,210 issued on Jan. 19, 2010, which is a continuation of U.S. patent application Ser. No. 11/947,644 filed on Nov. 29, 2007 and now U.S. Pat. No. 8,007,051 issued on Aug. 30, 2011, which is a continuation-in-part of U.S. patent application Ser. No. 11/844,586 filed on Aug. 24, 2007 and now U.S. Pat. No. 7,600,823 issued on Oct. 13, 2009. U.S. patent application Ser. No. 11/844,586 is a continuation in-part of U.S. patent application Ser. No. 11/829,761 filed on Jul. 27, 2007 and now U.S. Pat. No. 7,722,127 issued on May 25, 2010. U.S. patent application Ser. No. 11/829,761 is a continuation-in-part of U.S. patent application Ser. No. 11/773,271 filed on Jul. 3, 2007 and now U.S. Pat. No. 7,997,661 issued on Aug. 16, 2011.

U.S. patent application Ser. No. 11/773,271 is a continuation in-part of U.S. patent application Ser. No. 11/766,903 filed on Jun. 22, 2007. U.S. patent application Ser. No. 11/766,903 is a continuation of U.S. patent application Ser. No. 11/766,865. U.S. patent application Ser. No. 11/766,865 is a continuation-in-part of U.S. patent application Ser. No. 11/742,304 filed on Apr. 30, 2007 and now U.S. Pat. No. 7,475,948 issued on Jan. 13, 2009. U.S. patent application Ser. No. 11/742,304 is a continuation of U.S. patent application Ser. No. 11/742,261 filed on Apr. 30, 2007 and now U.S. Pat. No. 7,466,971 issued on Dec. 16, 2008. U.S. patent application Ser. No. 11/742,261 is a continuation in-part of U.S. patent application Ser. No. 11/464,008 filed on Aug. 11, 2006 and now U.S. Pat. No. 7,338,135 issued on Mar. 4, 2008. U.S. patent application Ser. No. 11/464,008 is a continuation in-part of U.S. patent application Ser. No. 11/463,998 filed on Aug. 11, 2006 and now U.S. Pat. No. 7,384,105 issued on Jun. 10, 2008. U.S. patent application Ser. No. 11/463,998 is a continuation in-part of U.S. patent application Ser. No. 11/463,990 filed on Aug. 11, 2006 and now U.S. Pat. No. 7,320,505 issued on Jan. 22, 2008. U.S. patent application Ser. No. 11/463,990 is a continuation-in-part of U.S. patent application Ser. No. 11/463,975 filed on Aug. 11, 2006 and now U.S. Pat. No. 7,446,294 issued on Nov. 4, 2008. U.S. patent application Ser. No. 11/463,975 is a continuation-in-part of U.S. patent application Ser. No. 11/463,962 filed on Aug. 11, 2006 and now U.S. Pat. No. 7,413,256 issued on Aug. 19, 2008. The present Application is also a continuation in-part of U.S. patent application Ser. No. 11/695,672 filed on Apr. 3, 2007 and now U.S. Pat. No. 7,369,086 issued on Jul. 8, 2008. U.S. patent application Ser. No. 11/695,672 is a continuation in-part of U.S. patent application Ser. No. 11/686,831 filed on Mar. 15, 2007 and now U.S. Pat. No. 7,568,770 issued on Aug. 4, 2009. All of these applications are here inincorporated by reference for all that they contain.

BACKGROUND

Brazes and welds that connect brittle materials, such as carbide, to metal tools often affect the integrity of the brittle material. Consequently, many efforts have been made to improve the way in which brittle material forming high impact surfaces are attached. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, all of which are herein incorporated by reference for all that they contain.

SUMMARY

In one aspect of the invention, a tool comprises a head and a shank assembly. The shank assembly has a tensioned element axially disposed within a bore of a collar and a distal end of the tensioned element is secured within or below the bore. The head has a cavity formed in its base end and is adapted to receive a proximal end of the tensioned element. The tensioned element has a radially extending catch adapted to interlock within the cavity of the head. The head is harder than the tensioned element.

The cavity may have an inwardly protruding catch. The inwardly protruding catch may be adapted to interlock with the radially extending catch. The inwardly protruding catch may be a hook, may be a taper, may form a slot, or combinations thereof. The radially extending catch may be a hook, may be a taper, may form a slot, or combinations thereof. An inside surface of the cavity may have a uniform inward taper.

An insert may be intermediate the inwardly protruding catch and the radially extending catch. The insert may be a ring, a snap ring, a split ring, or a flexible ring. The insert may be a plurality of balls, wedges, shims or combinations thereof. The insert may be a spring. The insert may be deformed under a pressure exerted on the tensioning element. The insert may comprise stainless steel. The insert may have a flat surface substantially normal to a central axis of the shank assembly.

The head may comprise a cemented metal carbide, polycrystalline diamond, cubic boron nitride, hardened steel, ceramics, zirconium, tungsten, silicon carbide, hardened metals, and combinations thereof. The base of the head may have an upward extending taper. The collar may have a seat complimentary to the base of the head. An interface between the base of the head and the seat may have a filler material. The head may have at least two segments jointed by a braze joint.

The tensioned element may have a clearance between its outer diameter and an inside surface of the bore. The distal end of the tensioned element may be secured within the collar by a tensioning mechanism. The tensioning mechanism may comprise a press fit, a taper, a spring, a threadform, and/or a nut. The tensioned element may be cold worked as tension is applied to the tensioned element.

The tool may be incorporated in drill bits, shear bits, percussion bits, roller cone bits or combinations thereof. The tool may be incorporated in mining picks, trenching picks, asphalt picks, excavating picks or combinations thereof. The tool may be incorporated into a flat surface, table top, or combinations thereof. The tool may be incorporated into mills, hammermills, cone crushers, jaw crushers, shaft impactors or combinations thereof. The tool may be packed tightly in groups of at least two tools.

BRIEF DESCRIPTION OF THE DRAWINGS

FIG. 4 is a cross-sectional diagram of another embodiment of a pick.

FIG. 5 is a cross-sectional diagram of another embodiment of a pick.

FIG. 6 is a perspective diagram of an embodiment of a wedge.

FIG. 7 is a cross-sectional diagram of another embodiment of a pick.

FIG. 8 is a cross-sectional diagram of another embodiment of a pick.

FIG. 9 is a cross-sectional diagram of another embodiment of a pick.

FIG. 10 is a perspective diagram of an embodiment of an insert.

FIG. 11 is a perspective diagram of another embodiment of an insert.

FIG. 12 is a perspective diagram of another embodiment of an insert.

FIG. 13 is a perspective diagram of another embodiment of an insert.

DETAILED DESCRIPTION

Figure 1:
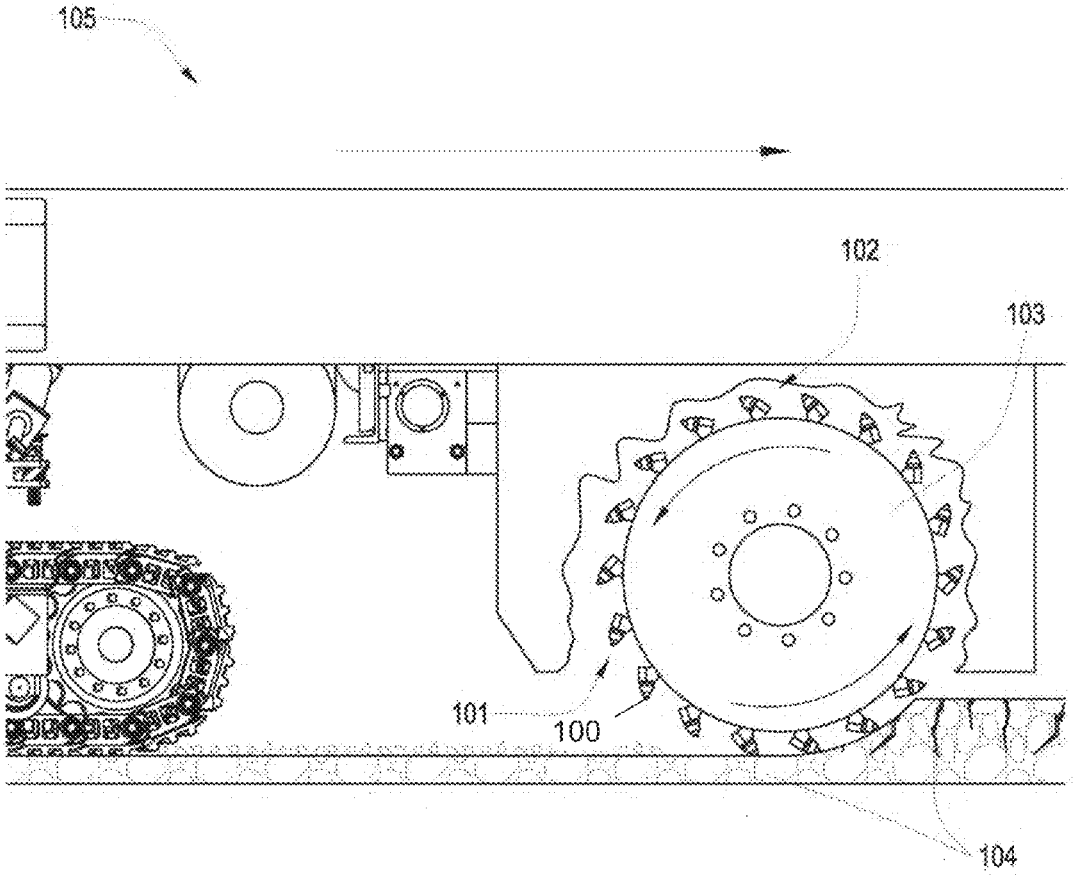
FIG. 1 is a cross-sectional diagram of an embodiment of a milling machine.

FIG. 1 is a cross-sectional diagram of an milling machine having an embodiment a tool 100 incorporated into a plurality of picks 101 attached to a driving mechanism 103, such as a rotating drum connected to the underside of a pavement milling machine 105. The milling machine 105 may be a cold planer used to degrade manmade formations such as a paved surface 104 prior to the placement of a new layer of pavement. Picks 101 may be attached to the driving mechanism 103 bringing the picks 101 into engagement with the formation. A holder 102, which may be a block, an extension in the block or a combination thereof, is attached to the driving mechanism 103, and the pick 101 is inserted into the holder 102. The holder 102 may hold the pick 101 at an angle offset from the direction of rotation, such that the pick 101 engages the pavement at a preferential angle. Each pick 101 may be designed for high-impact resistance and long life while milling the paved surface 104.

Figure 2:
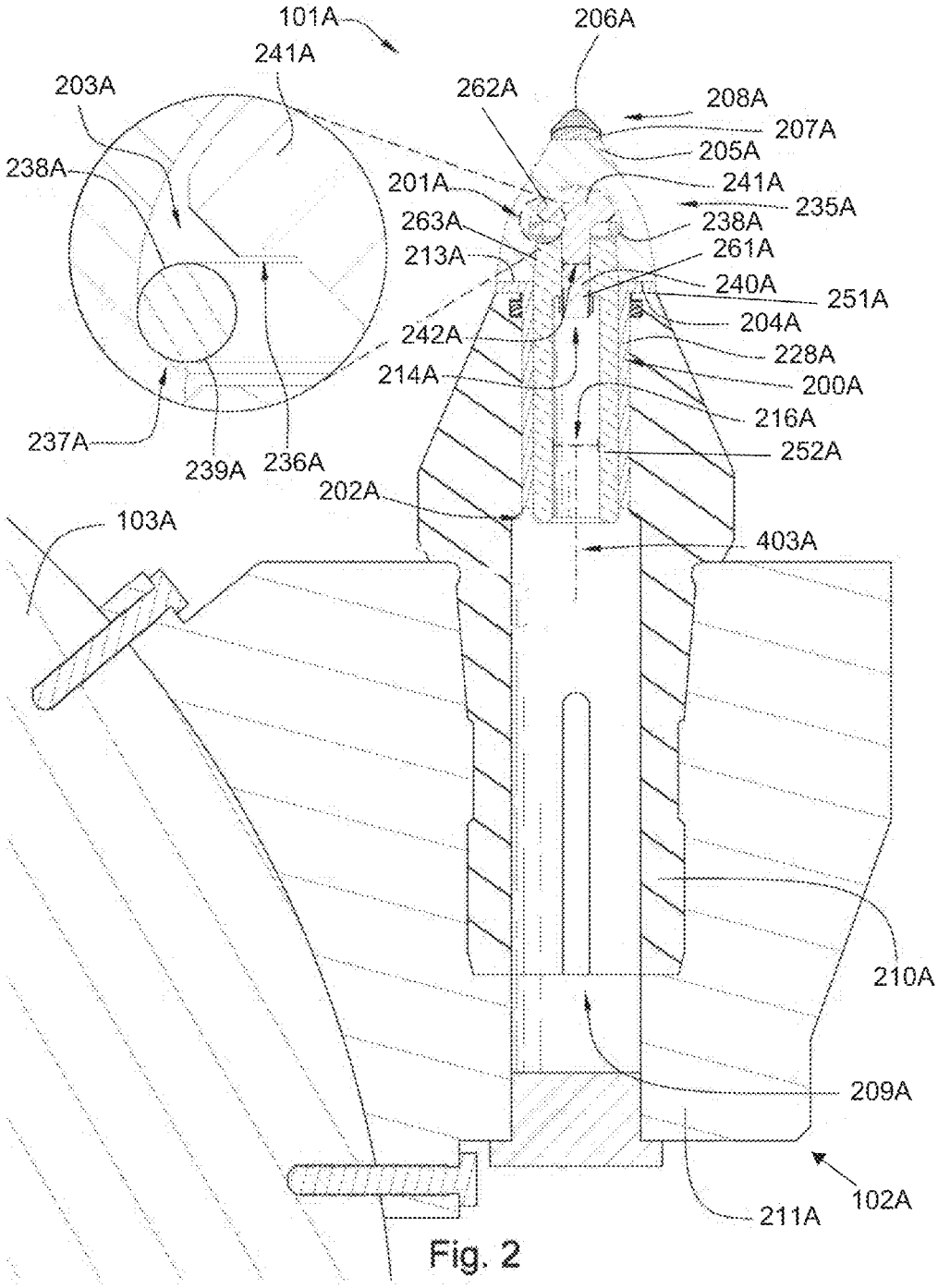
FIG. 2 is a cross-sectional diagram of an embodiment of an impact resistant pick.

Referring now to FIG. 2 an embodiment of a pick suitable for use in the milling machine of FIG. 1 is shown. A pick 101A comprises a shank assembly 200A having a proximal end 201A and a distal end 202A. The shank assembly 200A further includes a head 235A. The head 235A may have an impact tip 208A that is brazed to a bolster 205A. The bolster 205A is adapted to interlock with the shank assembly 200A. The proximal end 201A of the shank assembly 200A may be press fit into a cavity 203A in a base end 204A of the bolster 205A. A super hard material 206A may be bonded to a substrate 207A to form the impact tip 208A, which may then be bonded to the bolster 205A opposite the base end 204A of the bolster 205A, and opposite the proximal end 201A of the shank assembly 200A. In FIG. 2 the shank assembly 200A is generally cylindrical. The distal end 202A of the shank assembly 200A is disposed within a recess 209A of a holder 102A, which may comprise an extension 210A and a block 211A attached to driving mechanism 103A, or both.

An outer surface of the holder 102A may have hard-facing in order to provide better wear protection for the holder 102A. In some embodiments the hard-facing may have ridges after it is applied, although in some embodiments the ridges may be machined down after the hard facing is applied. In some embodiments a sleeve 228A is disposed between the pick 101A and the holder 102A. In some embodiments the base end 204A of the bolster 205A may be in direct contact with an upper face 213A of the sleeve 228A or an upper face 251A of the holder 102A The base end 204A of the bolster 205A may overhang the holder 102A and hard-facing, which may prevent debris from collecting on the upper face 251A of the holder 102A. The recess 209A of the holder 102A may have hard-facing. One method of hard-facing the recess 209A is case-hardening, during which process the recess 209A is enriched with carbon and/or nitrogen and then heat treated, which hardens the recess 209A and provides wear protection, although other methods of hard-facing the recess 209 may also be used. The shank assembly 200A is adapted to be retained within the recess 209A.

The shank assembly 200A may be formed of a hard material such as steel, stainless steel, hardened steel, or other materials of similar hardness. The bolster 205A may be formed of tungsten, titanium, tantalum, molybdenum, niobium, cobalt and/or combinations thereof. The super hard material 206A may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal-bonded diamond, silicon carbide, cubic boron nitride, and combinations thereof.

The shank assembly 200A may be work-hardened or cold-worked in order to provide resistance to cracking or stress fractures due to forces exerted on the pick 101A by the impact surface such as paved surface 104 of FIG. 1 or the holder 102A. The shank assembly 200A may be work-hardened by shot-peening or by other methods of work-hardening. The shank assembly 200A may also be rotatably held into the holder 102A, such that the pick 101A is allowed to rotate within the holder 102A. At least a portion of the shank assembly 200A may also be work-hardened by stretching it during the manufacturing process.

The shank assembly 200A includes a tensioned element 214A and a collar 252A. The tensioned element 214A is axially disposed within a bore 242A of the collar 252A and a distal end 261A of the tensioned element 214A is secured within or below the bore 242A. A proximal end 262A of the tensioned element 214A protrudes into the cavity 203A in the base end 204A of the bolster 205A. A proximal end 263A of the collar 252A may be press fit into the cavity 203A in the base end 204A of the bolster 205A. The tensioned element 214A is adapted to lock the proximal end 201A of the shank assembly 200A within the cavity 203A. The tensioned element 214A may attach the shank assembly 200A to the bolster 205A and restrict movement of the shank assembly 200A with respect to the bolster 205A. The tensioned element 214A has a radially extending catch 236A that is formed in the proximal end 201A of the shank assembly 200A. The shank assembly 200A may be prevented by the tensioned element 214A from moving in a direction parallel to a central axis 403A of the pick 101A. In some embodiments the shank assembly 200A may be prevented by the tensioned element 214A from rotating about the central axis 403A.

In FIG. 2 the cavity 203A has an inwardly protruding catch 237A. An insert 238A is disposed between the inwardly protruding catch 237A of the cavity 203A and the radially extending catch 236A of the proximal end 201A of the shank assembly 200A. In some embodiments the insert 238A is a flexible ring 239A. In some embodiments the insert 238A may be a ring, a snap ring, a split ring, coiled ring, a flexible ring 239A or combinations thereof. In FIG. 2 the tensioned element 214A has a locking shaft 240A. The locking shaft 240A is connected to an expanded locking head 241A. In some embodiments the radially extending catch 236A is an undercut formed in the locking head 241A. The insert 238A and locking head 241A are disposed within the cavity 203A of the bolster 205A. The locking shaft 240A protrudes from the cavity 203A and into an inner bore 216A of the shank assembly 200A. The locking shaft 240A is disposed within the bore 242A of the collar 252A at the proximal end 201A of the shank assembly 200A. The locking shaft 240A is adapted for translation in a direction parallel to the central axis 403A of the shank assembly 200A. The locking shaft 240A may extend from the cavity 203A and the insert 238A may be inserted into the cavity 203A.

When the proximal end 201A of the tensioned element 214A is inserted into the cavity 203A, the locking head 241A may be extended away from the bore 242A of the collar 252A. The insert 238A may be disposed about the locking shaft 240A and be between the locking head 241A and the bore 242A. The insert 238A may be formed of stainless steel. In some embodiments the insert 238A may be formed of an elastomeric material and may be flexible. The insert 238A may be a ring, a snap ring, a split ring, a coiled ring, a rigid ring, segments, balls, shims, a spring or combinations thereof.

Figure 2A:
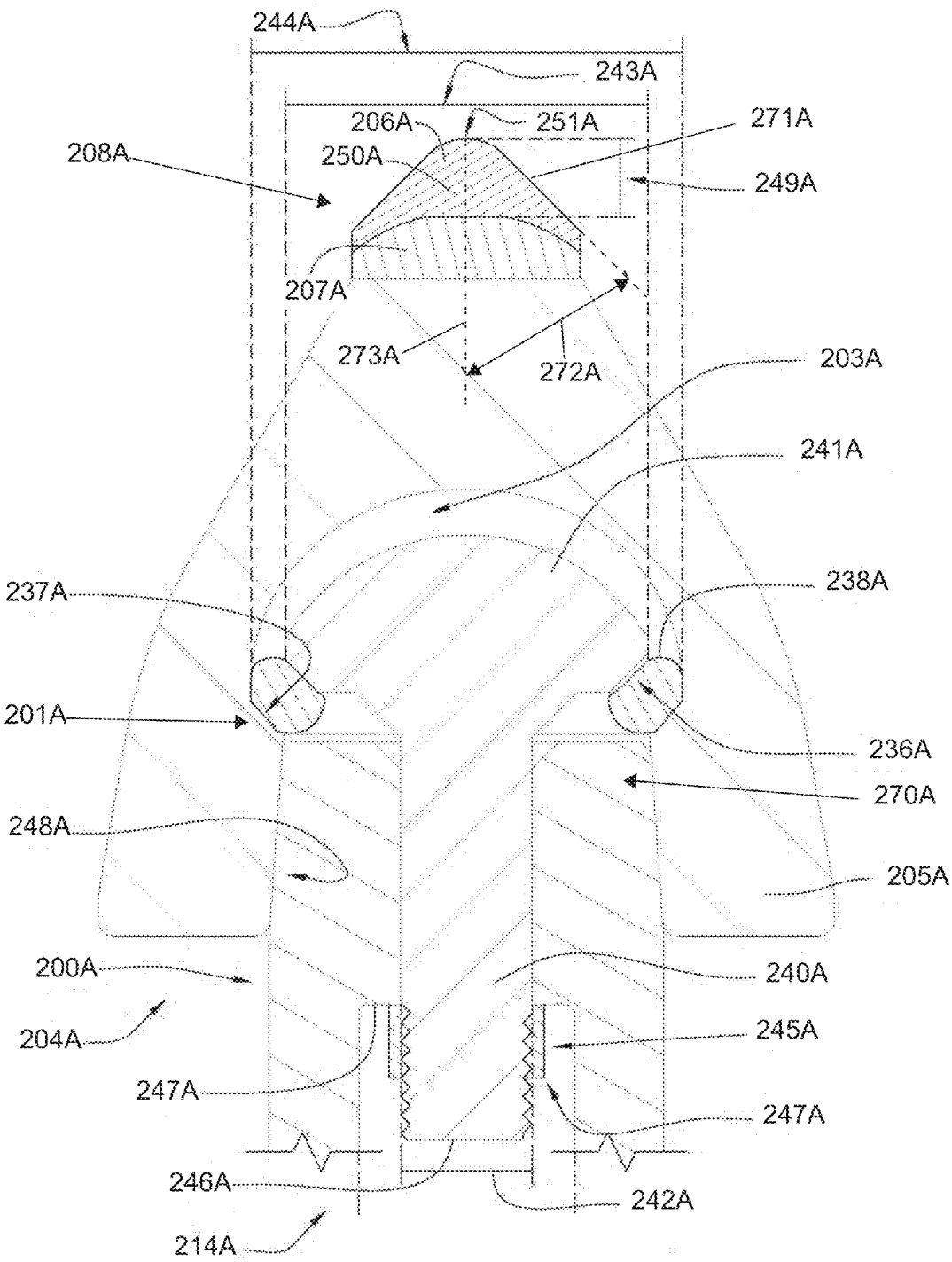
FIG. 2*a* is a cross-sectional diagram of another embodiment of a pick.

Referring now to FIG. 2*a*, the insert 238A may shave a breadth 244A that is larger than a breadth 243A of an opening 270A of the cavity 203A. In such embodiments the insert 238A may compress to have a smaller breadth 244A than the breadth 243A of the opening 270A. Once the insert 238A is past the opening 270A, the insert 238A may expand to its original or substantially original breadth 244A. With both the insert 238A and the locking head 241A inside the cavity 203A, the rest of the proximal end 201A of the shank assembly 200A may be inserted into the cavity 203A of the bolster 205A. Once the proximal end 201A of the shank assembly 200A is inserted into the cavity 203A to a desired depth, a nut 245A may be threaded onto an exposed end 246A of the locking shaft 240A until the nut 245A contacts a ledge 247A proximate the constricted inner diameter 242A. This contact and further threading of the nut 245A on the locking shaft 240A may cause the locking shaft 240A to move toward the distal end 202A (shown in FIG. 2) of the shank assembly 200A in a direction parallel to the central axis 403A of the shank assembly 200A. This may also result in bringing the radially extending catch 236A of the locking head 241A into contact with the insert 238A, and bringing the insert 238A into contact with the inwardly protruding catch 237A of the cavity 203A. The nut 245A is an embodiment of a tensioning mechanism 247A. The tensioning mechanism 247A is adapted to apply a rearward force on the proximal end 201A of the shank assembly 200A. The rearward force may pull the proximal end 201A of the shank assembly 200A in the direction of the distal end 202A. In some embodiments the tensioning mechanism 247A may be a press fit, a taper, and/or a nut 245A.

Once the nut 245A is threaded tightly onto the locking shaft 240A, the locking head 241A and insert 238A are together too wide to exit the opening 270A. In some embodiments the contact between the locking head 241A and the bolster 205A via the insert 238A may be sufficient to prevent both rotation of the shank assembly 200A about its central axis 403A and movement of the shank assembly 200A in a direction parallel to its central axis 403A. In some embodiments the tensioned element 214A is also adapted release the shank assembly 200A from attachment with the carbide bolster 205A by removing the nut 245A from the locking shaft 240A.

In some embodiments the insert 238A may be a snap ring. The insert 238A may be formed of stainless steel and may be deformed by the pressure of the locking head 241A being pulled towards the distal end 202A of the shank assembly 200A. As the insert 238A deforms it may become harder. The deformation may also cause the insert 238A to be complementary to both the inwardly protruding catch 237A and the radially extending catch 236A. This dually complementary insert 238A may avoid point loading or uneven loading, thereby equally distributing contact stresses. In such embodiments the insert 238A may be inserted when it is comparatively soft, and then may be work hardened while in place proximate the catches 236A, 237A.

In some embodiments at least part of the shank assembly 200A of the pick 101A may also be cold worked. The tensioned element 214A may be stretched to a critical point just before the strength of the tensioned element 214A is compromised. In some embodiments, the locking shaft 240A, locking head 241A, and insert 238A may all be cold worked by tightening the nut 245A until the locking shaft 240A, the locking head 241A, and the insert 238A, reach a stretching critical point. During this stretching, the insert 238A, the locking shaft 240A and the locking head 241A, may all deform to create a complementary engagement, and may then be hardened in that complementary engagement. In some embodiments the complementary engagement may result in an interlocking between the radially extending catch 236A and the inwardly protruding catch 237A.

In the embodiment of FIG. 2*a*, both the inwardly protruding catch 237A and the radially extending catch 236A are tapers. Also in FIG. 2*a*, the base end 204A of the bolster 205A comprises a uniform inward taper 248A. The impact tip 208A in FIG. 2*a* comprises a diamond 250A bonded to the substrate 207. In some embodiments the diamond 250A may have a volume that is 75% to 175% of a volume of the substrate 207A.

The diamond 250A is an embodiment of a superhard material 206A and has a generally conical shape with an apex 251A. A thickness 249A of the diamond 250A at the apex 251A may be from 0.100 inch to 0.500 inch. The substrate 207A may have a height of 0.090 inch to 0.250 inch. The superhard material 206A bonded to the substrate 207A may have a substantially pointed geometry with an apex 251A having a radius from 0.050 inch to 0.160 inch. Preferably, an interface between the substrate 207A and the superhard material 206A is nonplanar, which may help distribute loads on the tip 208A across a larger area of the interface. The side wall 271A of the superhard material 206A may form an included angle 272A with a central axis 273A of the tip 208A between 30 degrees and 60 degrees. In asphalt milling applications, the inventors have discovered that an optimal included angle is 45 degrees, whereas in mining applications the inventors have discovered that an optimal included angle is between 35 degrees and 40 degrees. A tip 208A that may be compatible with the present invention is disclosed in U.S. patent application Ser. No. 11/673,634 to Hall and is currently pending.

The impact tip 208A may be brazed onto the bolster 205A at a braze interface. Braze material used to braze the tip 208A to the bolster 205A may have a melting temperature from 700 degrees Celsius to 1200 degrees Celsius; preferably the melting temperature is from 800 degrees Celsius to 970 degrees Celsius. The braze material may be silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material have 30 to 62 weight percent palladium, preferably 40 weight percent to 50 weight percent palladium. Additionally, the braze material may have 30 weight percent to 60 weight percent nickel, and 3 weight percent to 15 weight percent silicon; preferably the braze material may have 47.2 weight percent nickel, 46.7 weight percent palladium, and 6.1 weight percent silicon. Active cooling during brazing may be critical in some embodiments, since the heat from brazing may leave some residual stress in the bond between the substrate 207A and the super hard material 206A. The farther away the super hard material 206A is from the braze interface, the less thermal damage is likely to occur during brazing. Increasing the distance between the brazing interface and the super hard material 206A, however, may increase the moment on the carbide substrate 207A and increase stresses at the brazing interface upon impact. The shank assembly 200A may be press fitted into the bolster 205A before or after the tip 208A is brazed onto the bolster 205A.

Figure 3A:
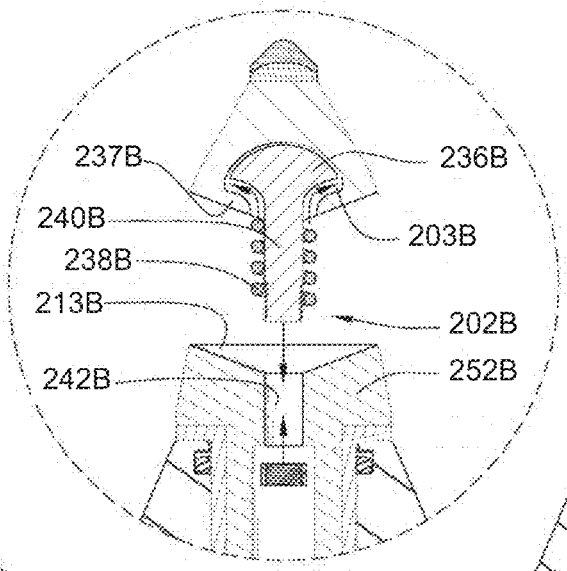
FIG. 3*a* is a close up, cross-sectional diagram of the pick of FIG. 3 showing a of another embodiment of a pick.
Figure 3:
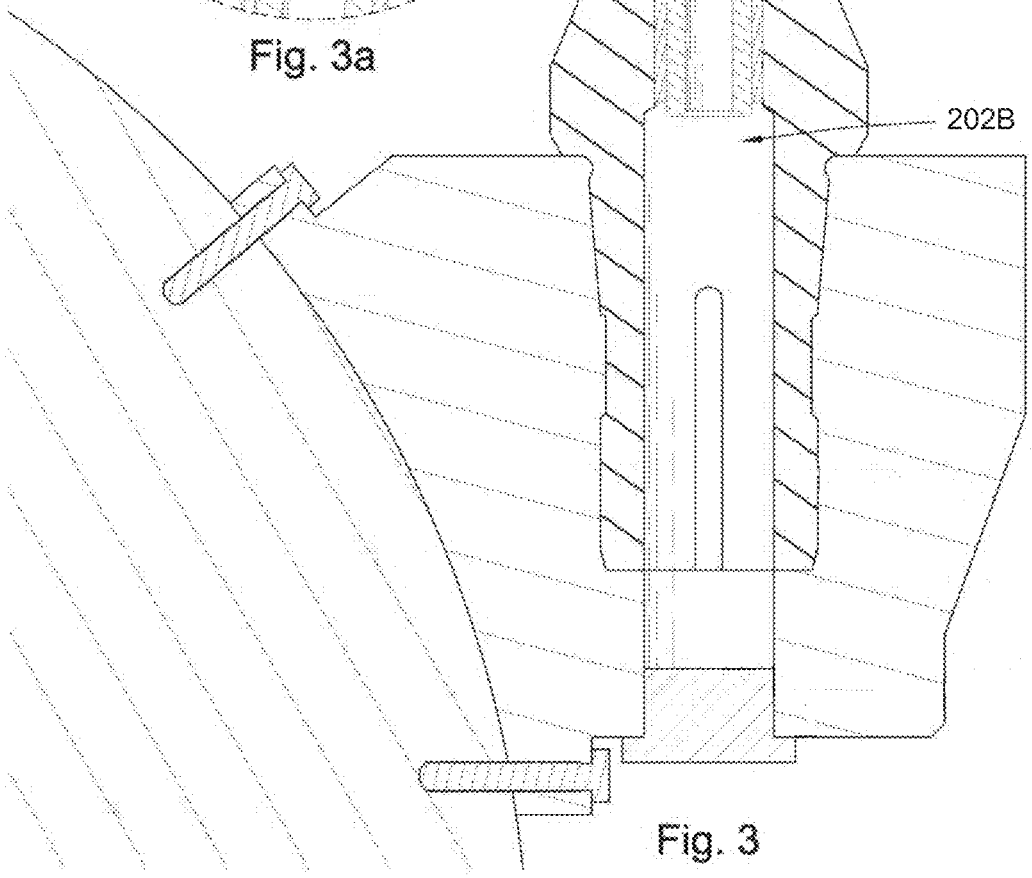
FIG. 3 is a cross-sectional diagram of another embodiment of a pick.

Referring now to the embodiments of FIGS. 3-3*a*, an insert 238B may be a coil spring. The coil spring insert 238B may be inserted into a cavity 203B of a bolster 205B by placing the coil spring insert 238B around a locking shaft 240B before inserting the locking shaft 240B into a bore 242 of a collar 252B. As the locking shaft 240B is inserted into the bore 242B, an upper face 213B of the collar 252B pushes the coil spring insert 238B into the cavity 203B between a radially extending catch 236B and an inwardly protruding catch 237B. It is believed that the coil spring insert 238B will be beneficial in that it may be easier to place in the cavity 203B than the before mentioned insert geometries. The radially extending catch 236B may have a conically curved geometry. In other embodiments, the radially extending catch 236B may have a radius or a curved geometry. The upper face 213B may taper inward towards the bore 242B and downward towards a distal end 202B.

Referring now to FIGS. 4-6, a variety of embodiments of an insert are disclosed. In FIG. 4, an embodiment of a bolster 205C is shown with a flexible insert 401 being inserted into a cavity 203C while a locking shaft 240C and a locking head 241C are already inside the cavity 203C. In FIG. 5, an embodiment of a bolster 205D is shown with a wedge 501 disposed within a cavity 203 between an inwardly protruding catch 237B and a radially extending catch 236B of a locking head 241D. FIG. 6 discloses a perspective view of an embodiment of the wedge 501 of FIG. 5. In some embodiments of the invention, the insert may be one or more wedges 501. One wedge 501 may be already present in the cavity 203D when the locking head 241D is inserted into the cavity 203D. Additional wedges 502 may be inserted into the cavity 203D while the locking head 241D is already present in the cavity 203D.

FIGS. 7-9 disclose top-view cross-sectional diagrams of bolsters 205E, 205F, 205G. In FIG. 7 an inwardly protruding catch 237E is visible. In FIG. 8 a plurality of wedges 501F are disposed on an inwardly protruding catch 237F. In FIG. 9, a plurality of balls 901 is disposed on an inwardly protruding catch 237G. An insert may be a plurality of balls 901, wedges 501F, shims, or combinations thereof.

FIGS. 10-13 disclose various embodiments of inserts 238H, 238J, 238K, 238L. FIG. 10 discloses an insert 238H having a plurality of interlocked segments 1001. FIG. 11 discloses an insert 238J having a plurality of abutting segments 1101. FIG. 12 discloses an embodiment of an insert 238K that is a snap ring 1201K. FIG. 13 discloses an embodiment in which an insert 238L is a ring 1301L. In some embodiments the ring 1301L may be flexible.

Figure 14:
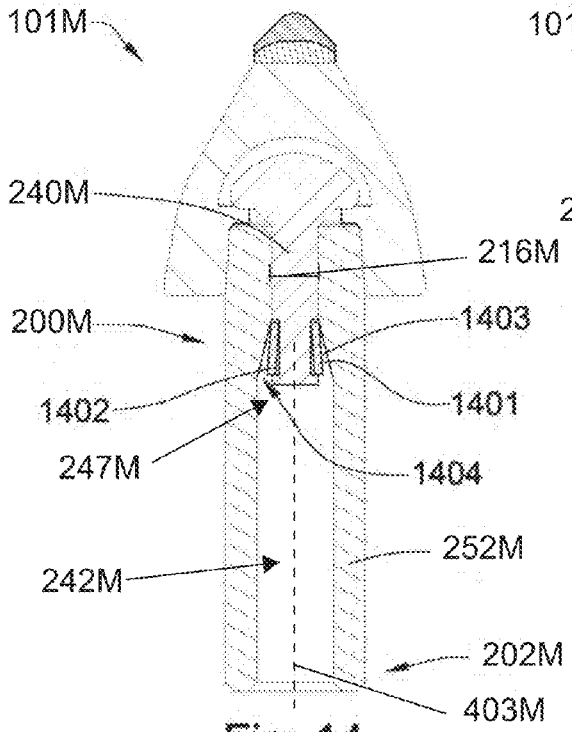
FIG. 14 is a cross-sectional diagram of another embodiment of a pick.

FIGS. 14-19 disclose various embodiments of picks with differing tensioning mechanisms. FIG. 14 discloses a pick 101M in which a tensioning mechanism 247M may have a retaining clip 1401 adapted to fit in an inset portion 1402 of a locking shaft 240M. An interior surface 1403 of a collar 252M comprises a transition taper 1404 between a bore 242M of the collar 252M and an inner diameter 216M. The retaining clip 1401 may be adapted to expand away from a central axis 403M of the pick 101M. As the retaining clip 1401 expands it may press against the transition taper 1404, thereby causing a tension on the locking shaft 240M directed towards a distal end 202M of the shank assembly 200M.

Figure 15:
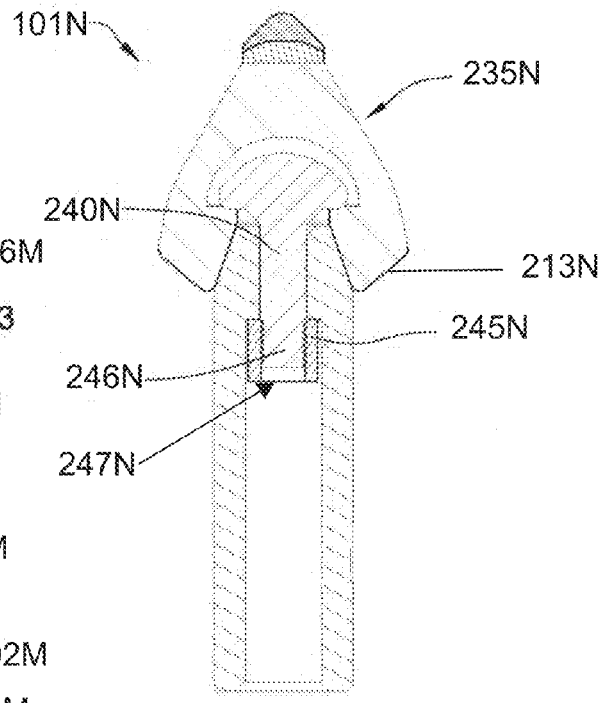
FIG. 15 is a cross-sectional diagram of another embodiment of a pick.

FIG. 15 discloses a pick 101N in which a tensioning mechanism 247N includes a nut 245N. The nut 245N may be threaded onto an exposed end 246N of a locking shaft 240N. The nut 245N may be selected from a group consisting of hex nuts, Allen nuts, cage nuts, cap nuts or combinations thereof. The nut 245N disclosed in FIG. 15 is an Allen nut. A base 213N of a bolster 235N is tapered and adapted to fit complementary into a pick holder (such as holder 102A of FIG. 2). Such a taper is believed to reduce the stress between the holder and the bolster 235N as well as support the bolster 235N under side loads.

Figure 16:
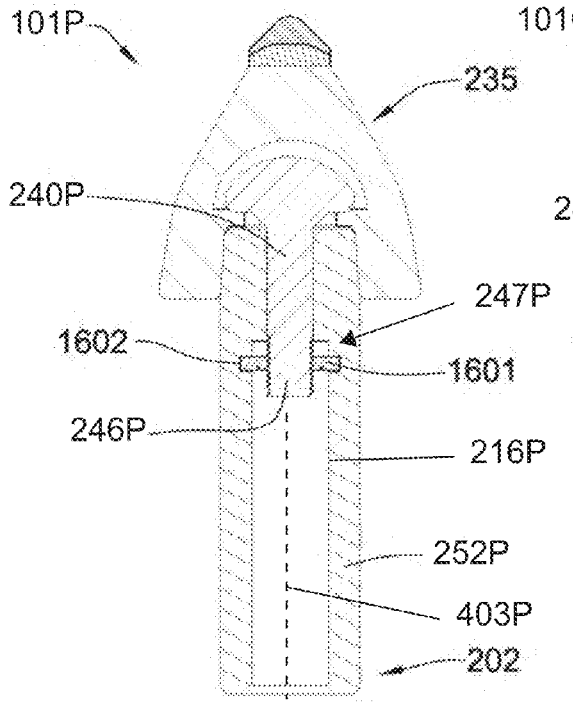
FIG. 16 is a cross-sectional diagram of another embodiment of a pick.

FIG. 16 discloses a pick 101P in which a tensioning mechanism 247P may include a snap ring 1601 adapted to fit in an expanded diameter region 1602 formed in an inner surface 216 of a collar 252P. The expanded diameter region 1602 may retain the snap ring 1601 from movement a long the central axis 403P. The snap ring 1601 may be able to rotate within the expanded region 1602 about the central axis 403P. The snap ring 1601 may be internally threaded and adapted to receive an exposed end 246P of a locking shaft 240P.

Figure 17:
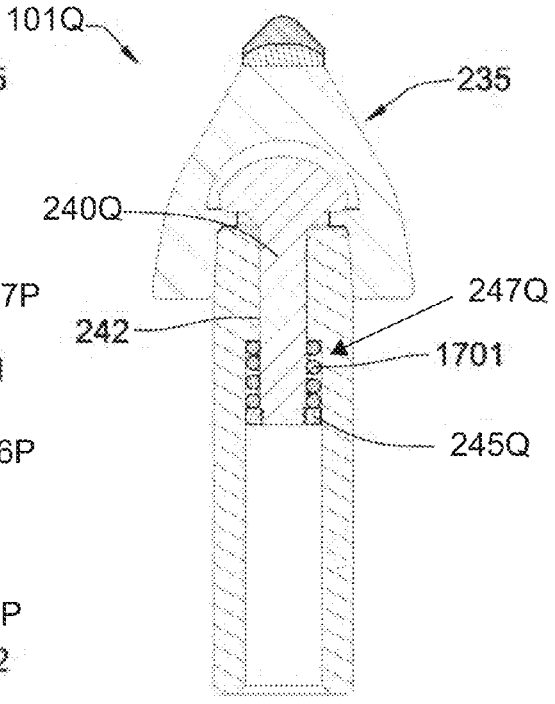
FIG. 17 is a cross-sectional diagram of another embodiment of a pick.

FIG. 17 discloses a pick 101Q in which the tensioning mechanism 247Q may include a spring 1701 disposed between a nut 245Q or snap ring (not shown) and a bore 242Q. The spring 1701Q may be disposed around a locking shaft 240Q.

Figure 18:
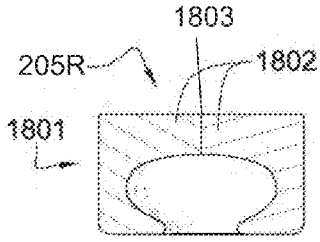
FIG. 18 is a cross-sectional diagram of an embodiment of a tool head.

FIGS. 18-31 illustrate cross sections of various embodiments of bolsters having cavities for receiving a locking head. In the embodiment of FIG. 18 a bolster 205R has a generally rectangular cross-sectional geometry 1801. The bolster 205R may have at least two segments 1802 jointed by a braze joint 1803.

Figure 19:
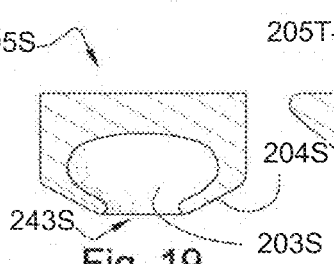
FIG. 19 is a cross-sectional diagram of another embodiment of a tool head.

In the embodiment of FIG. 19 a base end 204S of a bolster 205S may taper inward towards an opening 243S of a cavity 203S of the bolster 205S.

Figure 20:
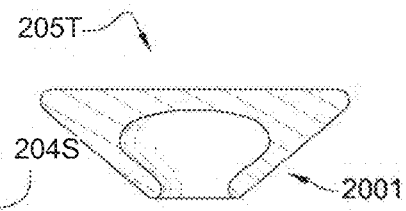
FIG. 20 is a cross-sectional diagram of another embodiment of a tool head.

In the embodiment of FIG. 20 a bolster 205T has a trapezoidal cross-sectional geometry 2001.

Figure 21:
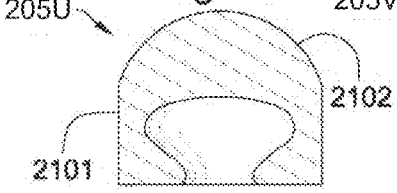
FIG. 21 is a cross-sectional diagram of another embodiment of a tool head.

In the embodiment of FIG. 21 a bolster 205U has a cylindrical body 2101 and a domed impact surface 2102.

Figure 22:
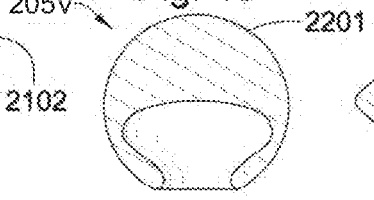
FIG. 22 is a cross-sectional diagram of another embodiment of a tool head.

In the embodiment of FIG. 22 a bolster 205V has a generally spherical geometry 2201.

Figure 23:
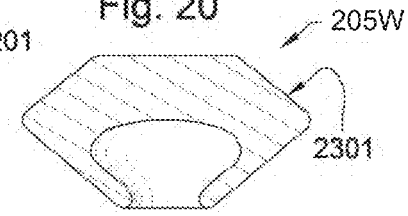
FIG. 23 is a cross-sectional diagram of another embodiment of a tool head.

In the embodiment of FIG. 23 a bolster 205W has a generally hexagonal cross-sectional geometry 2301.

Figure 24:
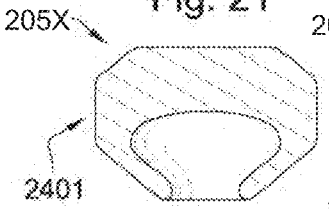
FIG. 24 is a cross-sectional diagram of another embodiment of a tool head.

In the embodiment of FIG. 24 a bolster 205X has a generally octagonal cross-sectional geometry 2401.

Figure 25:
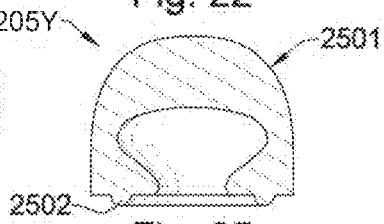
FIG. 25 is a cross-sectional diagram of another embodiment of a tool head.

In the embodiment of FIG. 25 a bolster 205Y has an elliptical geometry 2501. A base end 204Y of the bolster 205Y has a protuberance 2502, knob, bump, or combinations thereof.

Figure 26:
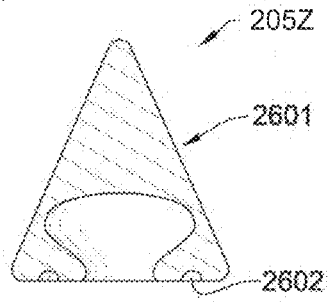
FIG. 26 is a cross-sectional diagram of another embodiment of a tool head.
Figure 27:
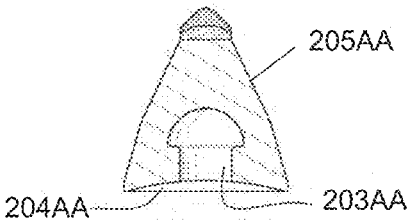
FIG. 27 is a cross-sectional diagram of another embodiment of a tool head.
Figure 28:
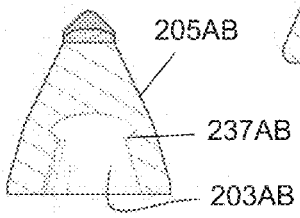
FIG. 28 is a cross-sectional diagram of another embodiment of a tool head.

In the embodiment of FIG. 26 a base end 204Z of a bolster 205Z may have a groove 2602, dimple, hollow or combinations thereof. An upper face of a collar (not shown) may be adapted to accommodate the protuberance 2502 of FIG. 25 or groove 2602. The bolster also has a generally triangular geometry 2601.

In the embodiment of FIG. 27*a* base end 204AA of a bolster 205AA may curve inward towards a cavity 203AA in the bolster 205AA.

In the embodiment of FIG. 28*a* cavity 203 AB of a bolster 205AB tapers inward to an inwardly protruding catch 237AB.

Figure 29:
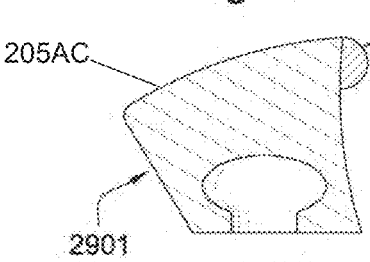
FIG. 29 is a cross-sectional diagram of another embodiment of a tool head.

In the embodiment of FIG. 29 a bolster 205AC has a backing surface 2901 generally opposing an impact tip 208AC or the impact surface.

Figure 30:
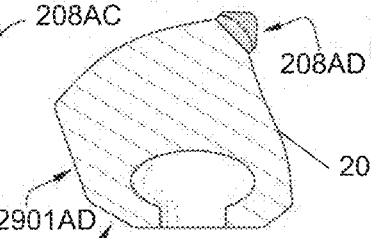
FIG. 30 is a cross-sectional diagram of another embodiment of a tool head.

In the embodiment of FIG. 30 a bolster 205AD has a first backing surface 2901AD and a second backing surface 3001. The first backing surface 2901AD and the second backing surface 3001 may share an interface with a collar (not shown), an extension (not shown) a block (not shown), a holder (not shown), a driving mechanism (not shown) or combinations thereof. It is believed that as the bolster contacts a formation the first backing surface 2901AD and the second backing surface 3001 may provide support to the head bolster 205AD preventing bending displacement of the bolster from occurring.

Figure 31:
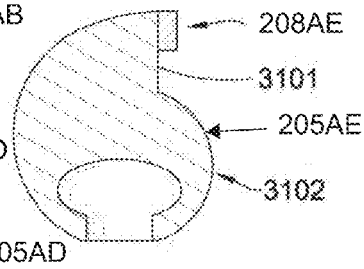
FIG. 31 is a cross-sectional diagram of another embodiment of a tool head.

Referring to the embodiment disclosed in FIG. 31, a bolster 235AE has a rounded body 3102 supporting a flat impact surface 310.1 An impact tip 208AE is brazed to the impact surface 3101.

A bolster may be formed of a material selected from a group consisting of cemented metal carbide, polycrystalline diamond, cubic boron nitride, hardened steel, ceramics, zirconium, and tungsten.

Figure 32:
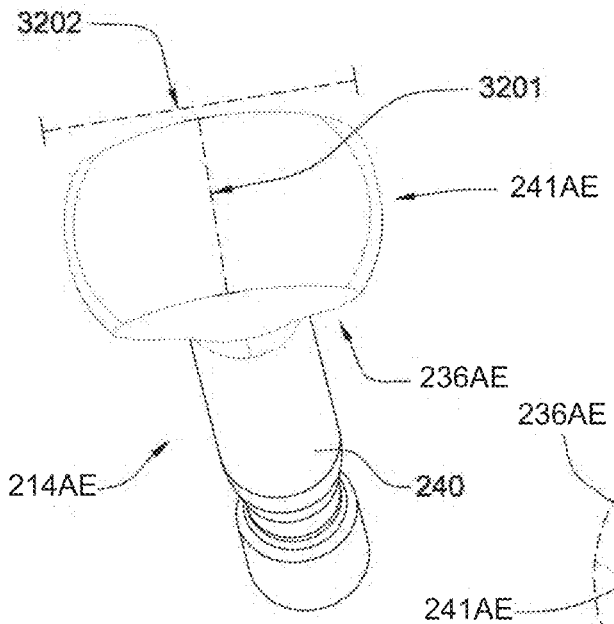
FIG. 32 is a perspective diagram of an embodiment of a shank assembly.
Figure 33:
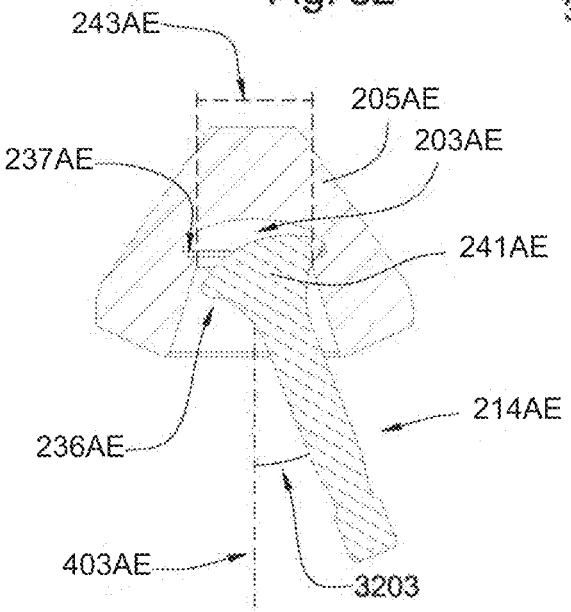
FIG. 33 is a cross-sectional diagram of an embodiment of a shank assembly and a head.
Figure 34:
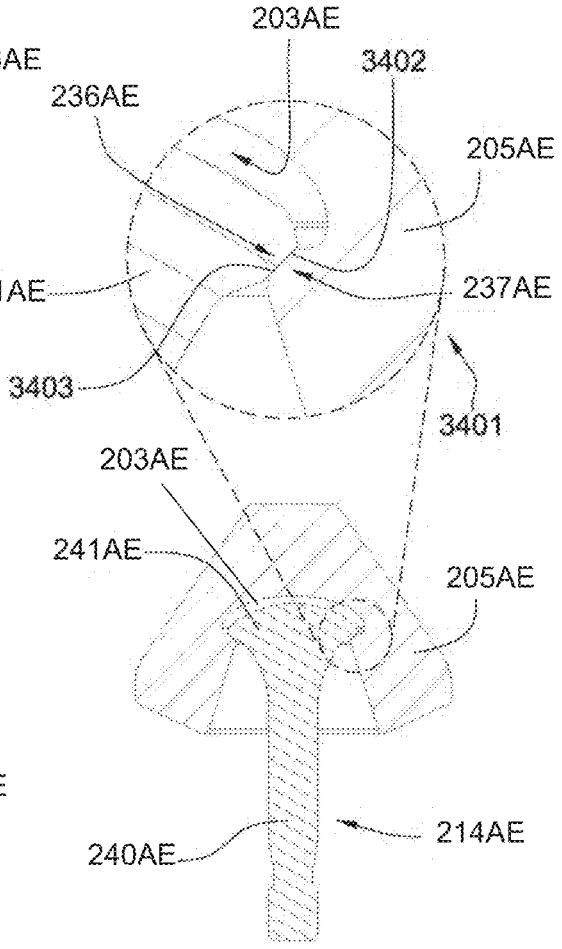
FIG. 34 is a cross-sectional diagram of another embodiment of a shank assembly and a head.

Referring now to FIGS. 32-34, an embodiment of a tensioned element 214AE is illustrated. The tensioned element 214AE has a radially extending catch 236AE. A cavity 203AE of a carbide bolster 205AE has an inwardly protruding catch 237AE. The tensioned element 214AE also has a locking head 241AE with a short diameter 3201 and a long diameter 3202. The short diameter 3201 is smaller than a diameter 243AE of an opening of the cavity 203AE and allows the locking head 241AE to be inserted into the cavity 203AE while held at an angle 3203 to a central axis 403AE of a pick 101AE. FIG. 34 discloses the locking head 241AE fully placed within the cavity 203AE and a locking shaft 240AE positioned parallel to the central axis 403AE of the pick 101AE. An enlarged view 3401 shows a taper 3402 of the radially extending catch 236AE of the locking head 241AE and a taper 3403 of the inwardly protruding catch 237AE of the cavity 203AE with the tapers 3402, 3403 being complementary.

Figure 35:
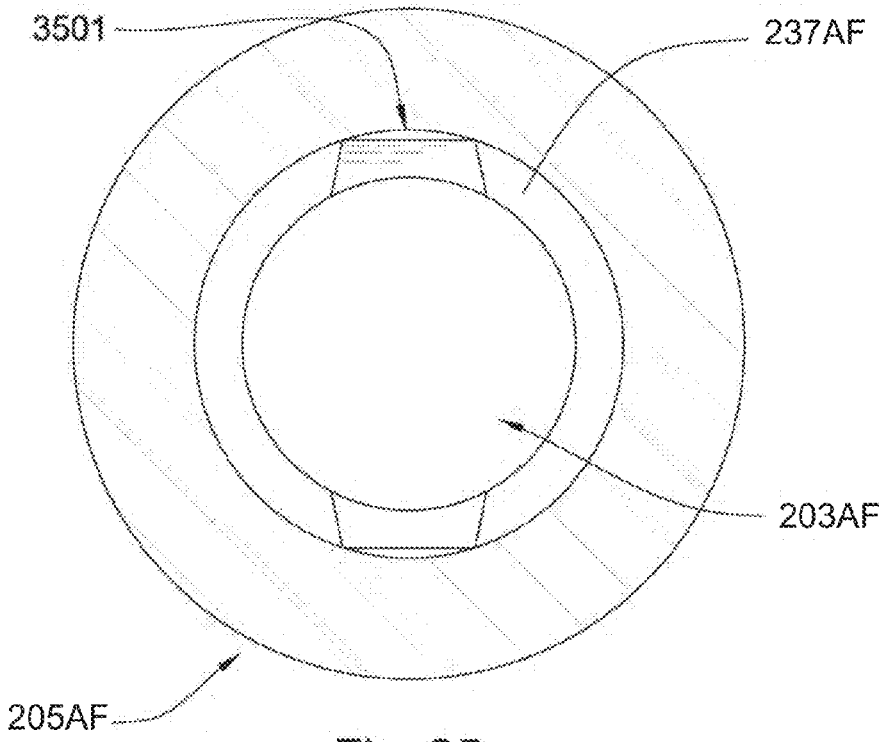
FIG. 35 is a cross-sectional diagram of another embodiment of a pick.
Figure 36:
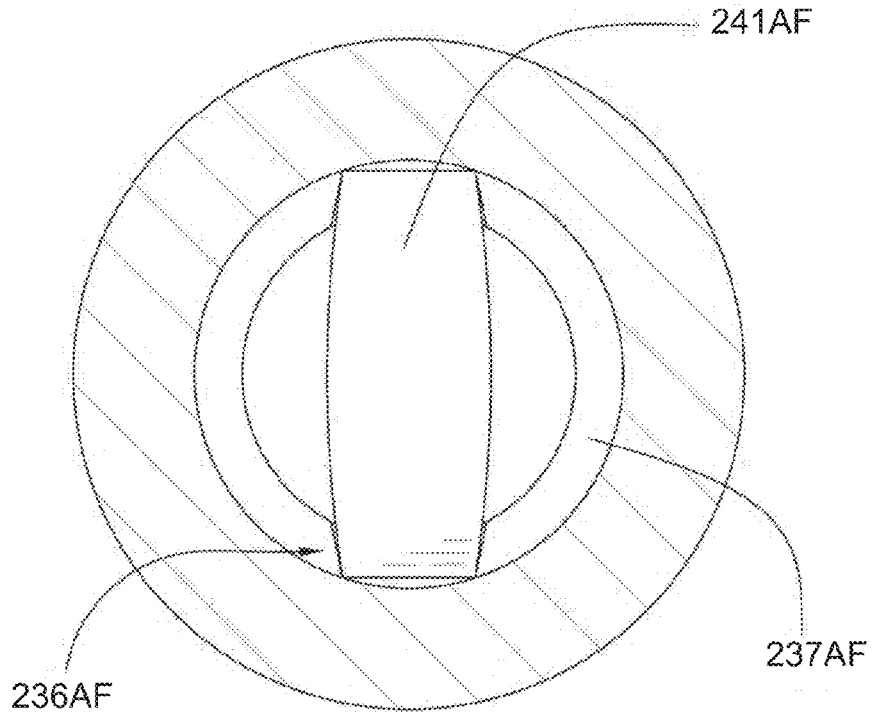
FIG. 36 is a cross-sectional diagram of another embodiment of a pick.

Referring now to FIGS. 35-36, an embodiment is disclosed in which an inwardly protruding catch 237AF of a cavity 203AF is adapted to interlock with a radially extending catch 236AF of a locking head 241AF of a tensioned element 214AF at a proximal end of a shank assembly. In FIG. 35 the inwardly protruding catch 237AF forms a seat 3501. The seat 3501 is recessed from the rest of the inwardly protruding catch 237AF. In FIG. 36 the radially extending catch 236AF of the locking head 241AF is shown within the seat 3501 and interlocked with the inwardly protruding catch 237AF.

Figure 37:
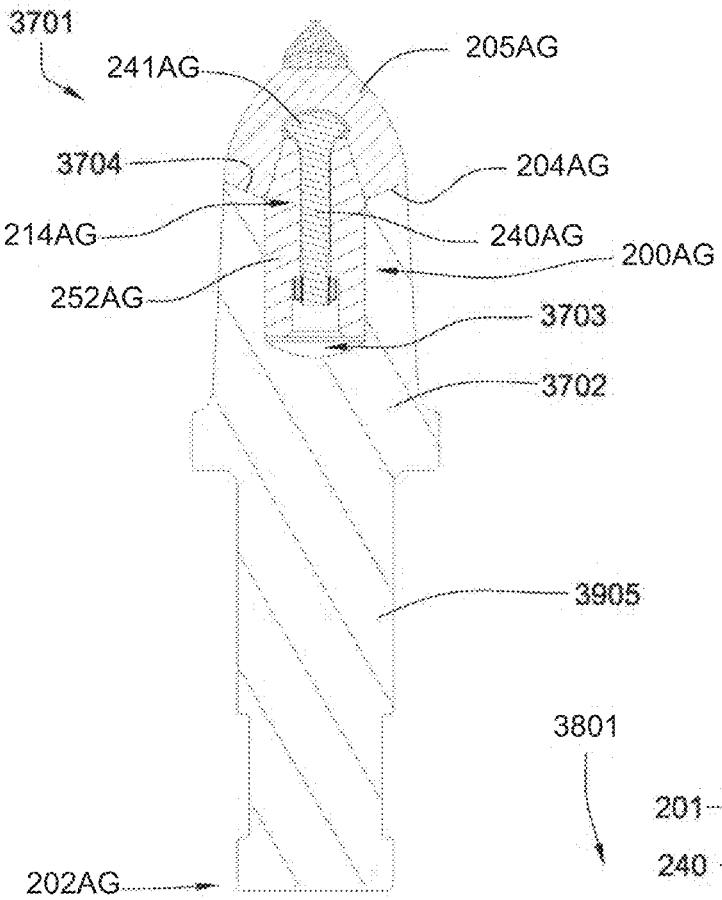
FIG. 37 is a cross-sectional diagram of an embodiment of a mining pick.
Figure 38:
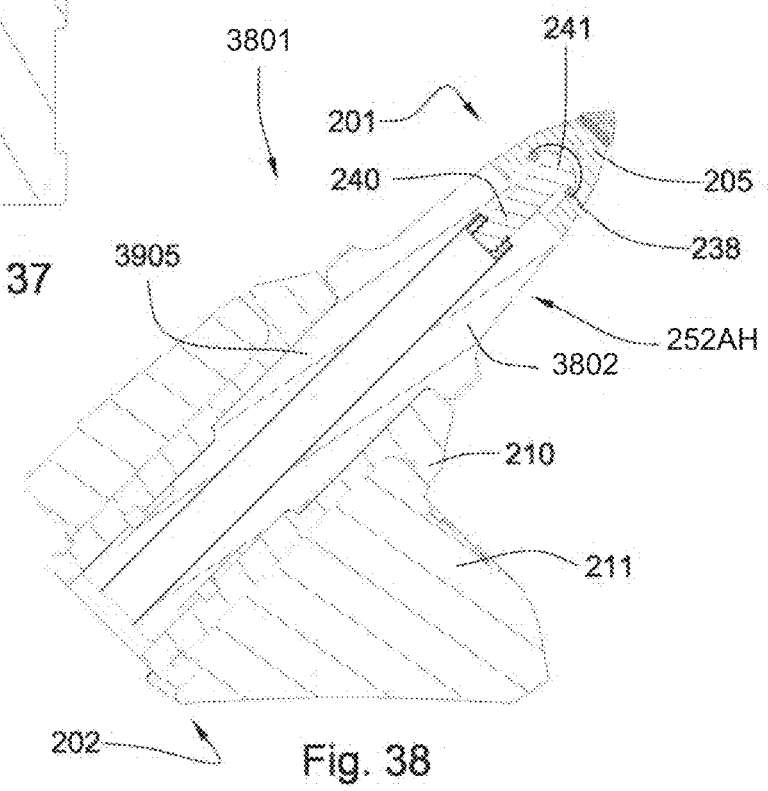
FIG. 38 is a cross-sectional diagram of another embodiment of a mining pick.

Referring now to FIG. 37-38, embodiments of a mining pick are disclosed. In the embodiment of FIG. 37, a mining pick 3701 comprises a steel body 3702 disposed adjacent a carbide bolster 205AG. A shank assembly 200AG disposed between the steel body 3702 and the carbide bolster 205AG comprises a tensioned element 214AG, a collar 252AG, and a locking shaft 240AG, and may continue to a distal end 202 of the pick 3701. The steel body 3702 comprises a central recess 3703, and a distal surface 3704 of the steel body 3702 is in contact with a base end 204AG of the carbide bolster 205AG. The locking shaft 240AG is disposed within the collar 252AG, and the collar 252AG is press fit into the central recess 3703 of the steel body 3702. The collar 252AG may also be brazed or otherwise connected to the steel body 3702. In some embodiments a locking head 241AG is inserted into a cavity 203AG of the carbide bolster 205AG before inserting the locking shaft 240AG into the collar 252AG. In such embodiments the collar 252AG is then subsequently press fit into the steel body 3702, or the collar 252AG may already be press fit into the steel body 3702.

FIG. 38 discloses an embodiment of a pick 3801 wherein a collar 252AH comprises a steel body 3802 and a steel shank 3705. The collar 252 may also comprise the extension 210, the block 211 or combinations thereof.

Figure 39:
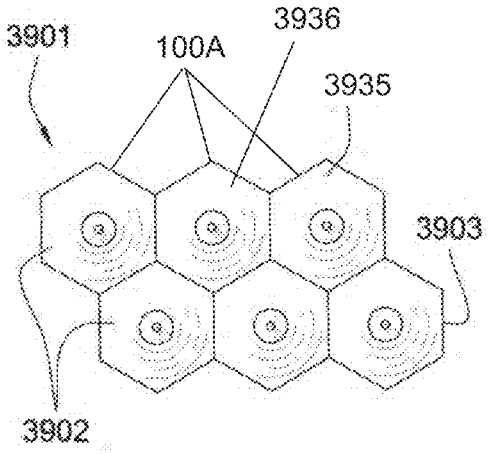
FIG. 39 is a orthogonal diagram of an embodiment of a tool assembly.

Referring now to FIGS. 39-42, a tool may be arranged in an array with at least two tools forming a tool assembly. FIG. 39 discloses an embodiment wherein the tool assembly 3901 has at least two tools 100A disposed adjacent to each other such that a head 3935 of a tool 100A is tightly packed against a head 3936 of a neighboring tool 100A in the tool assembly 3901. The heads 3936, 3935 of the tools 100A in the tool assembly 3901 form a continuous working surface 3902. The heads 3936, 3935 in the tool assembly 3901 each have a hexagonal perimeter 3903.

Figure 40:
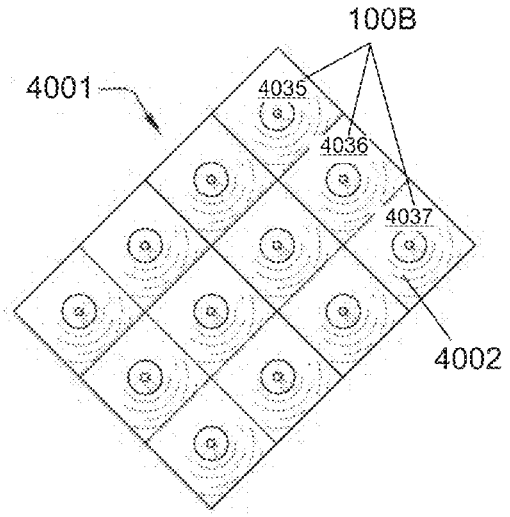
FIG. 40 is a orthogonal diagram of another embodiment of a tool assembly.

FIG. 40 discloses an embodiment in which a tool assembly 4001 has at least two tools 100B in which tool heads 4035, 4036, 4037 are packed tightly together. The tool heads 4035, 4036, and 4037 form a continuous working surface 4002. The heads 4035, 4036, 4037 of the tools assembly 4001 have a square perimeter.

Figure 41:
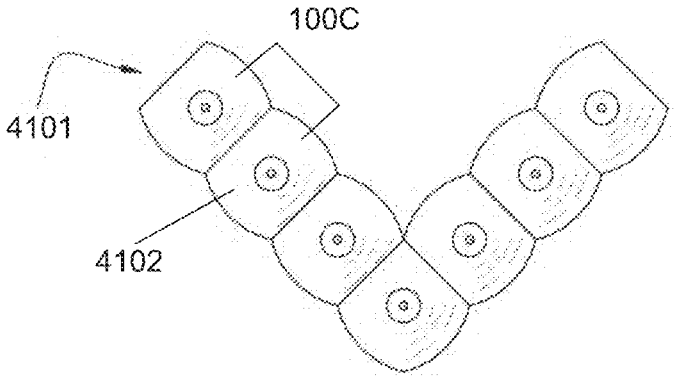
FIG. 41 is a orthogonal diagram of another embodiment of a tool assembly.

FIG. 41 discloses an embodiment of a tool assembly 4101 in which tools 100C are packed such that they are not aligned one with the other but still form a continuous working surface 4102.

Figure 42:
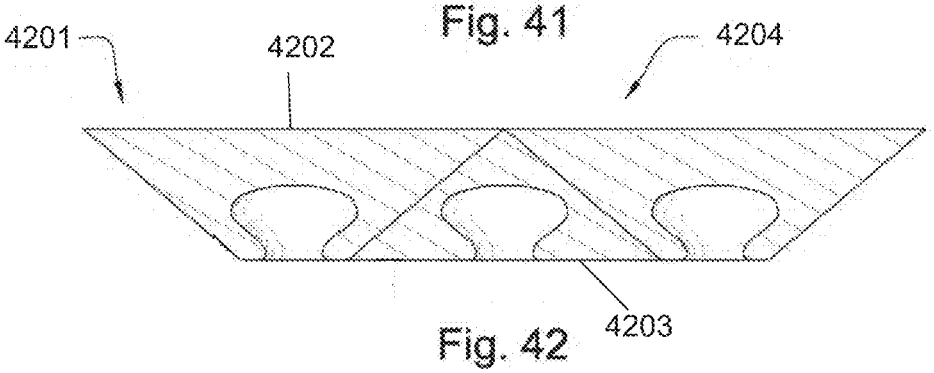
FIG. 42 is a cross-sectional diagram of another embodiment of a tool assembly.

In the embodiment of FIG. 42 a tool assembly 4201 may has heads 4202, 4203 of differing geometries. The differing geometries of the heads 4202, 4203 may be complimentary so as to form a continuous working surface 4204.

Figure 43:
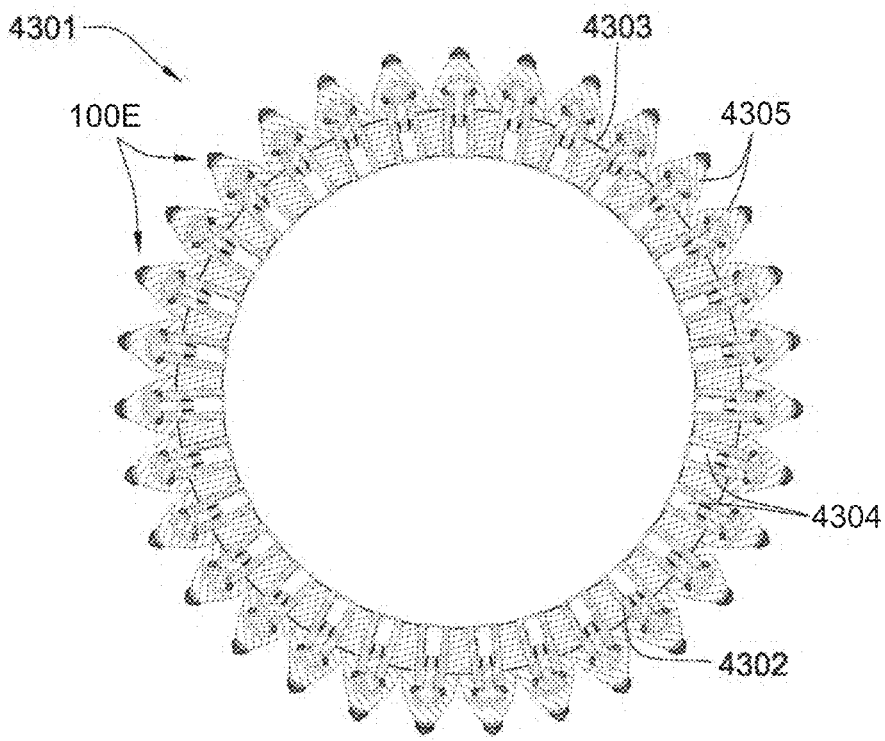
FIG. 43 is a cross-sectional diagram of an embodiment of a drum.

Referring to FIG. 43, a tool 100E may be used in a rotating drum 4301. A shank assembly 4304 of the tool 100E may be press-fitted into slots 4302 such that a head 4305 of the tool 100E is exposed. A plurality of tools 100E may be connected to the drum 4301 such that the outer surface 4303 of the drum 4301 is covered and protected by the heads 4305 of the tools 100E.

Figure 44:
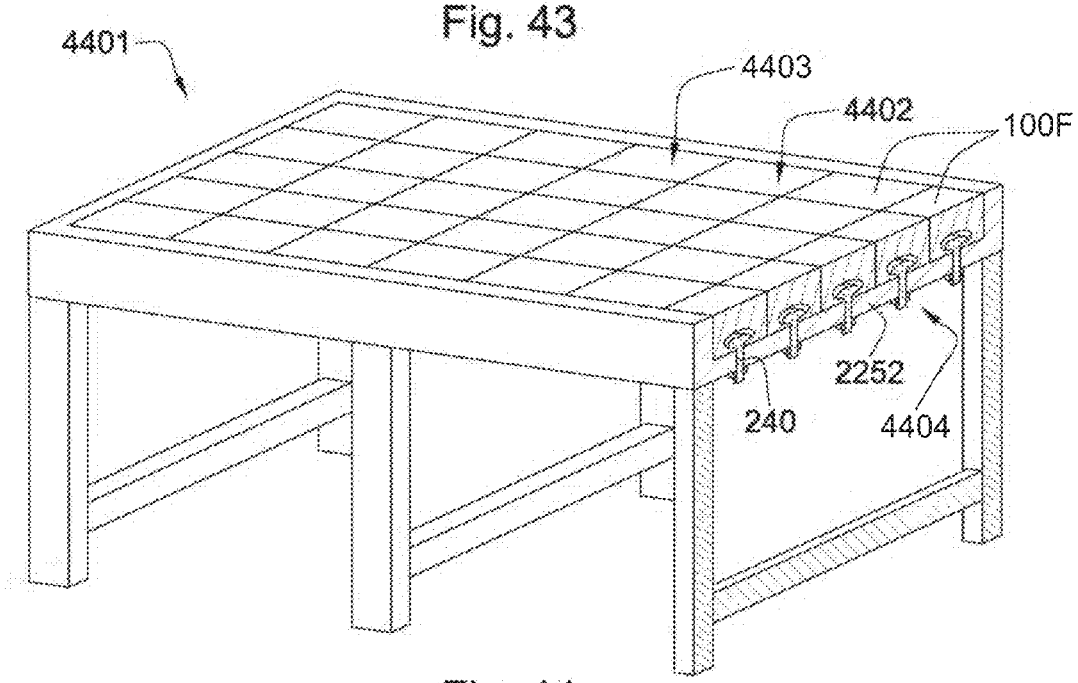
FIG. 44 is a cross-sectional diagram of an embodiment of a table.

The tool may be used in various applications. The tool may be incorporated into a flat surface, table top or combinations thereof. FIG. 44 discloses an embodiment of a table 4401 that with a table top 4402. The table top 4402 has a tool assembly 4403 consisting of at least two tools 100F. Tensioned elements 4404 may be disposed within a structural element 2252 such as a plate which may be shared by the at least two tools 100F. In other embodiments, the structural element 2252 may be a plate, collar, ball, foundation, beam, support, or combinations thereof.

Figure 45:
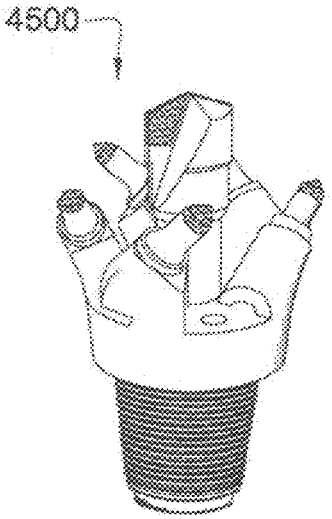
FIG. 45 is a perspective diagram of an embodiment of a drill bit.
Figure 46:
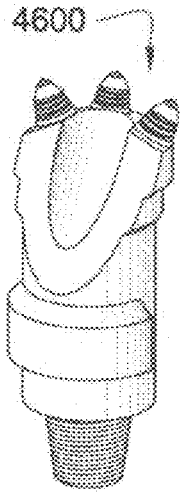
FIG. 46 is a perspective diagram of another embodiment of a drill bit.
Figure 47:
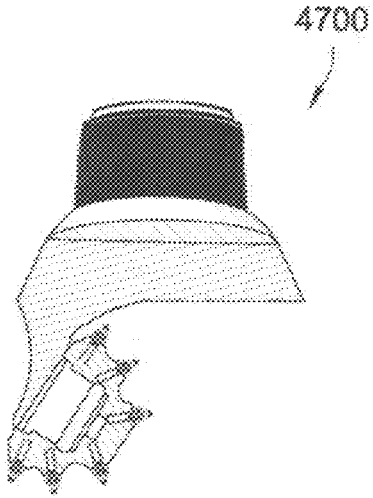
FIG. 47 is a perspective diagram of another embodiment of a drill bit.
Figure 48:
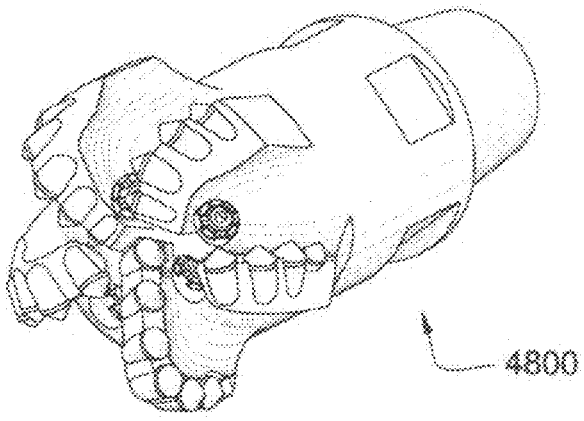
FIG. 48 is a perspective diagram of another embodiment of a drill bit.
Figure 49:
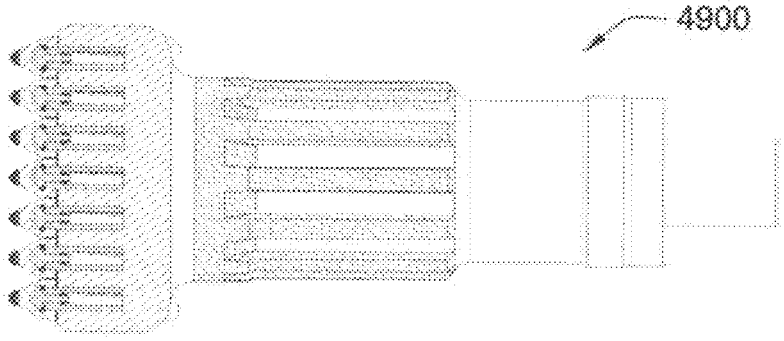
FIG. 49 is an orthogonal diagram of another embodiment of a drill bit.

FIGS. 45-58 illustrate various wear applications that may be incorporated with the present invention. FIG. 45 illustrates a drill bit 4500 typically used in water well drilling. FIG. 46 illustrates a drill bit 4600 typically used in subterranean, horizontal drilling. FIG. 47 illustrates a roller cone drill bit 4700 typically used in downhole, subterranean drilling. FIG. 48 illustrates a shear bit 4800 typically used in downhole, subterranean drilling. FIG. 49 illustrates a percussion bit 4900 typically used in downhole subterranean drilling. These bits 4500, 4600, 4700, 4800, 4900 and other bits are consistent with the present invention.

Figure 52:
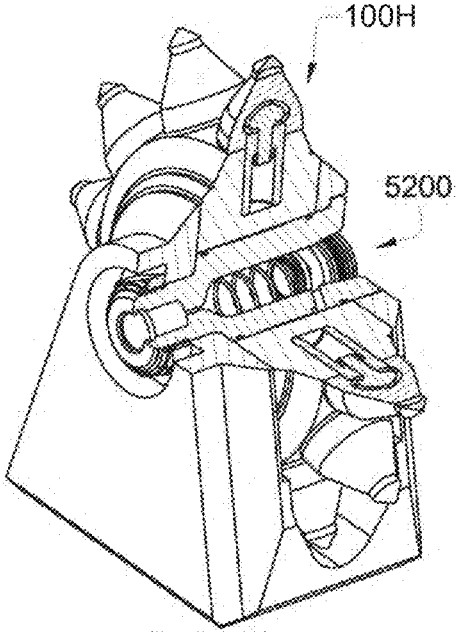
FIG. 52 is a cross-sectional diagram of an embodiment of a roller assembly.
Figure 50:
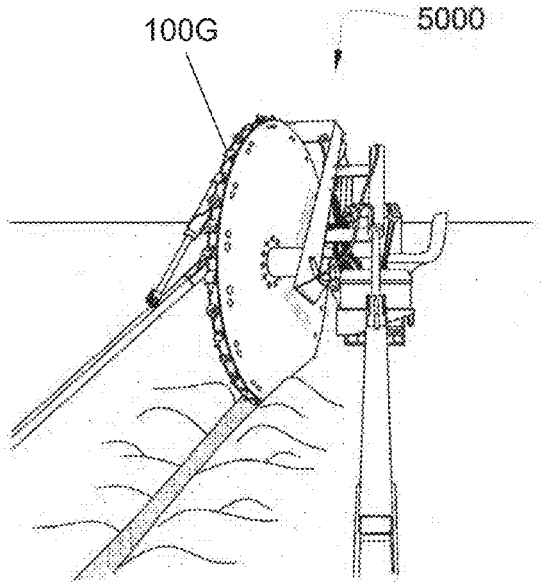
FIG. 50 is a perspective diagram of an embodiment of a trencher.
Figure 51:
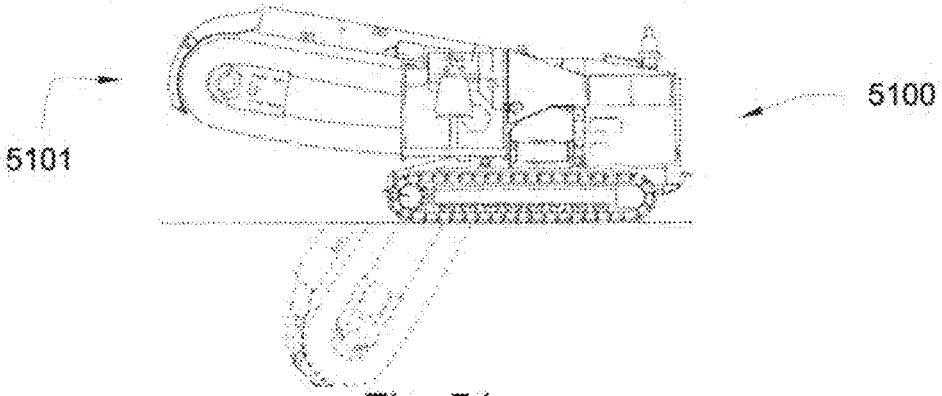
FIG. 51 is an orthogonal diagram of another embodiment of a trencher.

The tool may be used in a trenching machine, as disclosed in FIGS. 50 through 52. In FIG. 50 a tool 100G is disposed on a rock wheel trenching machine 5000. Referring to FIG. 51, tools (not shown) may be placed on a chain that rotates around an arm 5101 of a chain trenching machine 5100. In FIG. 52 an embodiment is illustrated in which a tool 100H may be disposed on a roller assembly 5200 that is mounted on a chain trenching machine or a rotating drum.

Figure 53:
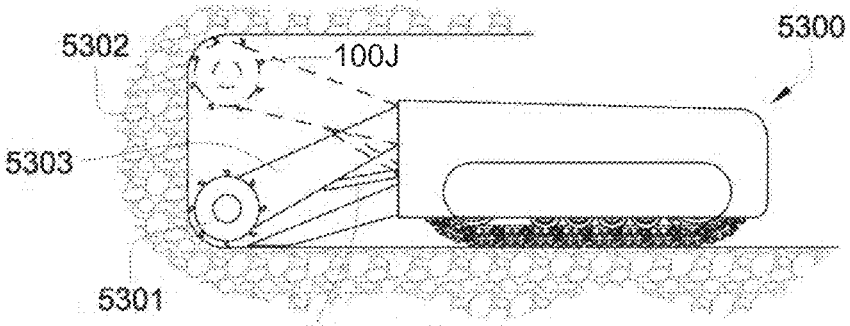
FIG. 53 is a perspective diagram of an embodiment a rotating drum attached to a mining machine.

FIG. 53 is an orthogonal diagram of an embodiment of a coal trencher 5300. Tools 100J may be connected to a rotating drum 5301 that is degrading coal 5302. The rotating drum 5301 is connected to an arm 5303 that moves the drum 5301 vertically in order to engage the coal 5302. The arm 5304 may move by a hydraulic arm 5305, it may also pivot about an axis or a combination thereof. The coal trencher 5300 may move about by tracks, wheels, or a combination thereof. The coal trencher 5300 may also move about in a subterranean formation. The coal trencher 5300 may be in a rectangular shape providing for easy mobility about the formation.

Figure 54:
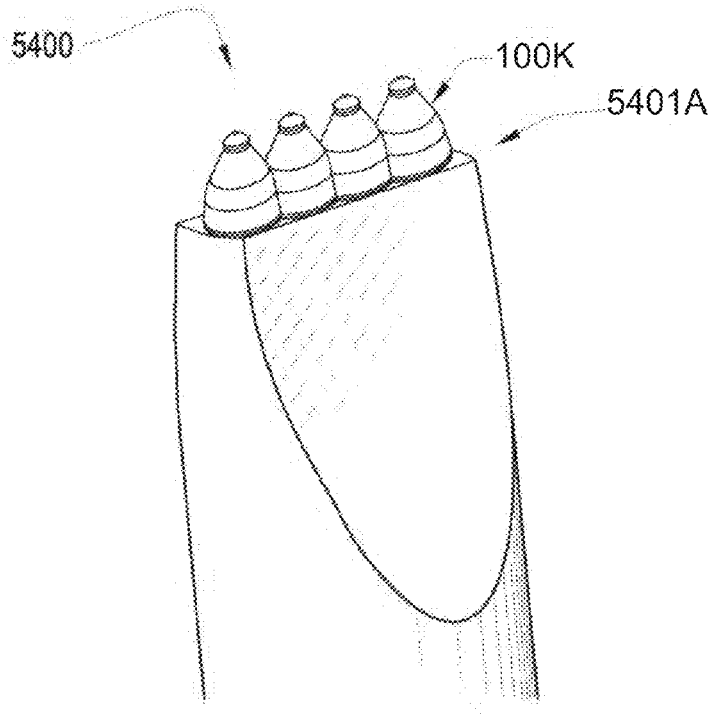
FIG. 54 is a perspective diagram of an embodiment of a chisel.
Figure 55:
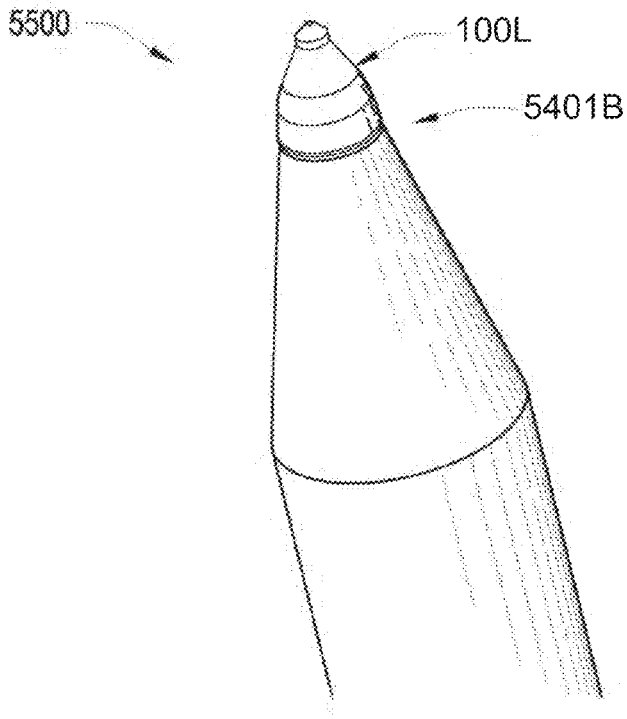
FIG. 55 is a perspective diagram of another embodiment of a chisel.

Referring now to FIGS. 54-55, chisels 5400 or rock breakers may also incorporate the present invention. At least one tool 100K, 100L may be placed on an impacting end 5401A, 5401B of a rock breaker with a chisel 5400 or moil geometry 5500.

Figure 56:
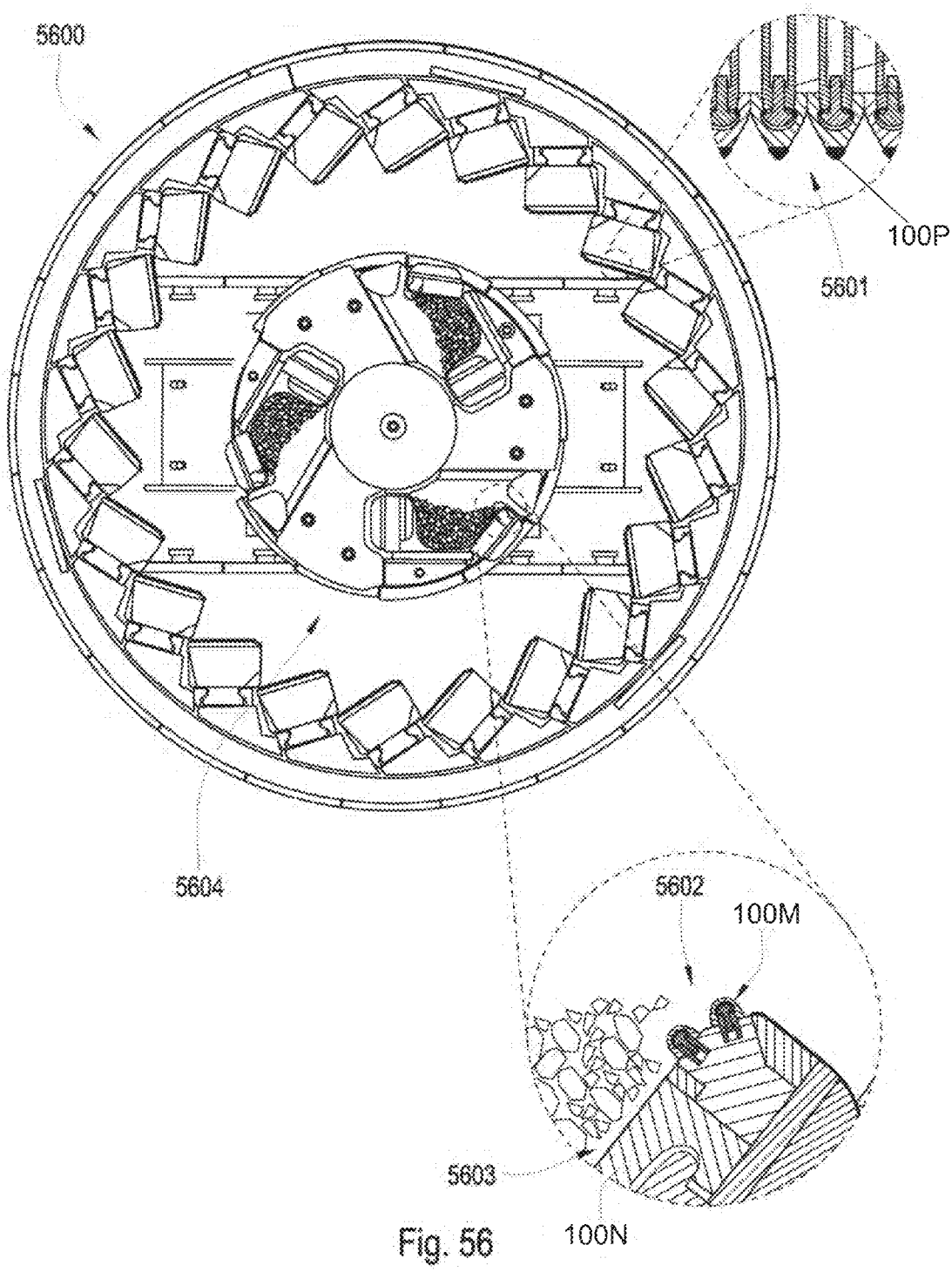
FIG. 56 is a orthogonal diagram of an embodiment of a vertical shaft impactor with two close up views.

Referring to FIG. 56, a tool 100M may also be incorporated into vertical shaft impactors 5600. The tools 100M, 100N, 100P may be used on targets 5601 such as tool 100P edges 5602 such as tool 100M, or a face 5603 of a central rotor 5604 such as tool 100N.

Figure 57:
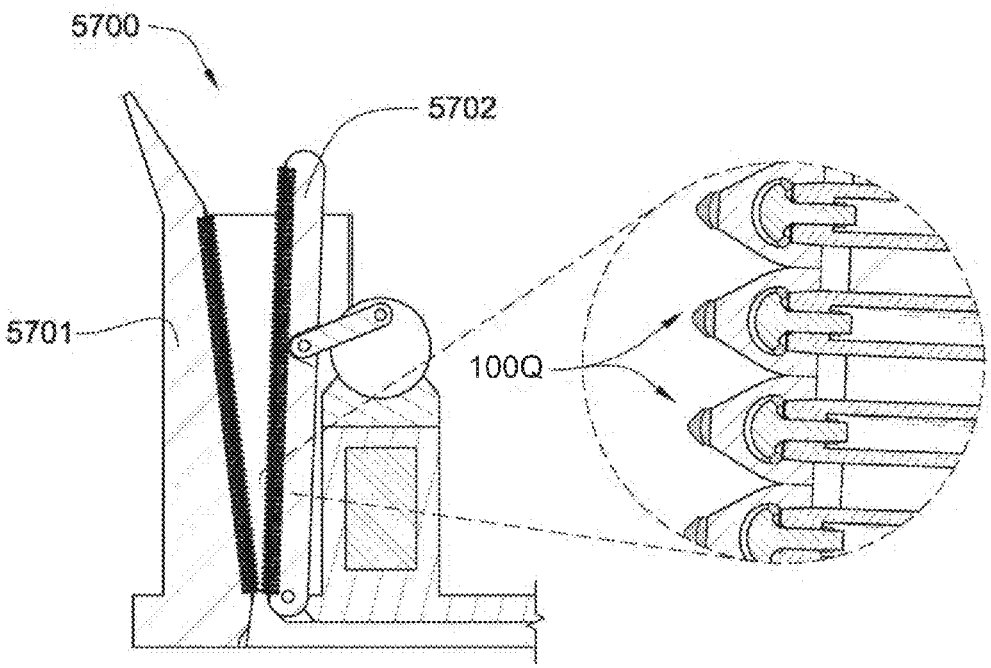
FIG. 57 is a cross-sectional diagram of an embodiment of a jaw crusher.
Figure 58:
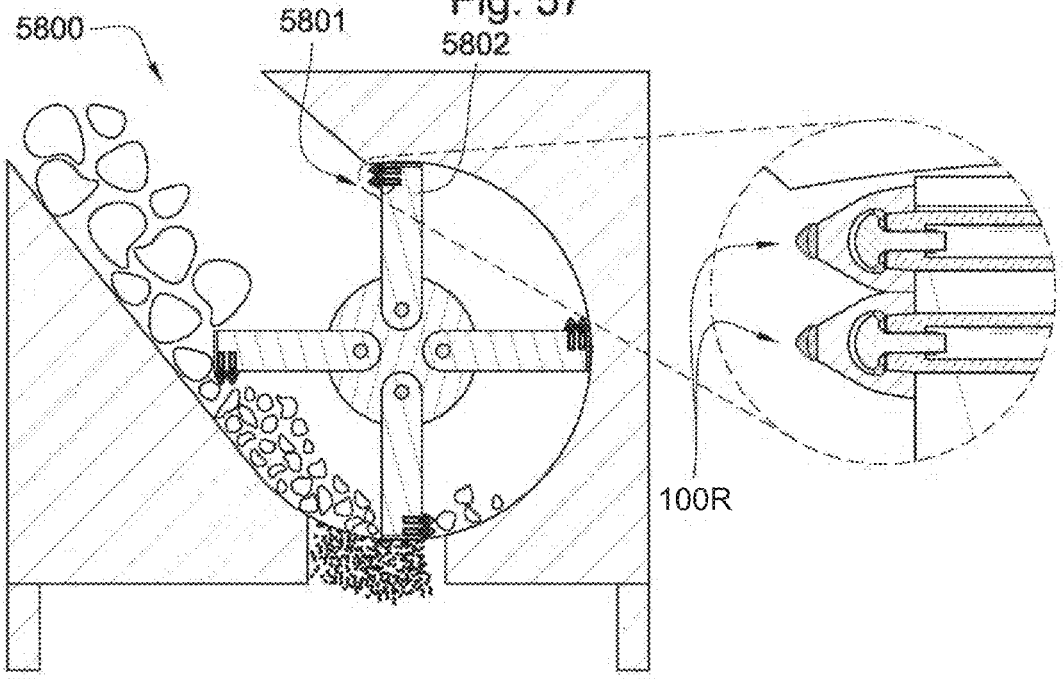
FIG. 58 is a cross-sectional diagram of an embodiment of a hammer mill.

Referring to FIGS. 57-58, a jaw crusher 5700 may have a fixed plate 5701 with a wear surface and pivotal plate 5702 with another wear surface. Rock or other materials are reduced as they travel down the plates 5701, 5702. Tools 100Q may be fixed to the plates 5701, 5702 and may be in larger size as the tools 100Q get closer to the pivotal end of the pivotal plate 5702. Hammer mills 5800 may incorporate tools 100R on a distal end 5801 of a hammer body 5802.

Other applications not shown, but that may also incorporate the present invention include rolling mills; cone crushers; cleats; studded tires; ice climbing equipment; mulchers; jackbits; farming and snow plows; teeth in track hoes, back hoes, excavators, shovels; tracks, armor piercing ammunition; missiles; torpedoes; swinging picks; axes; jack hammers; cement drill bits; milling bits; reamers; nose cones; and rockets.

Whereas the present invention has been described in particular relation to the drawings attached hereto, it should be understood that other and further modifications apart from those shown or suggested herein, may be made within the scope and spirit of the present invention.

What is claimed is:

1. A tool, comprising:

a head having a base end with a cavity formed therein, said cavity having an inward protruding catch forming an opening having a breadth, and said head having an impact surface spaced opposite said base end;

a collar having a proximal end, a distal end, a central axis, and a bore extending from said proximate end to said distal end, said bore having a wall and a shoulder formed therein, and said proximal end being disposed proximate said base end of said head;

an insert having a first breadth that is greater than said breath of said opening, said insert being compressible to a second breadth less than said breadth of said opening such that said insert may be passed through said opening of said cavity and return to said first breadth when in said cavity; and a tensioned element having a first end and a second end, a head disposed at said first end, said tensioned element having a radial extending catch sized and shaped to be retained within said cavity by said insert, said tensioned element disposed axially within said bore of said collar, and said second end of said tensioned element being secured to said shoulder.

2. The tool of claim 1, wherein said insert is disposed at least partly about said head of said tensioned element.

3. The tool of claim 2, wherein said insert includes at least one of a ring, a snap ring, a split ring, and a flexible ring.

4. The tool of claim 2, wherein said insert is deformed under a tension of said tensioned element.

5. The tool of claim 1, wherein said inwardly protruding catch includes at least one of a hook, a taper, and a slot.

6. The tool of claim 1, wherein said radially extending catch includes at least one of a hook and a taper.

7. The tool of claim 1, wherein said head is formed of a material selected from the group consisting of a cemented metal carbide, polycrystalline diamond, cubic boron nitride, hardened steel, ceramics, zirconium, tungsten, silicon carbide, and hardened metals.

8. The tool of claim 1, wherein said base end of said head has an upward extending taper.

9. The tool of claim 1, wherein said second end of said tensioned element is secured within said collar by a tensioning mechanism.

10. The tool of claim 9, wherein said tensioning mechanism includes at least one of a press fit, a taper, a threadform, a spring, and a nut.

11. The tool of claim 1, wherein said cavity has a uniform inward taper.

12. The tool of claim 1, wherein said insert has a flat surface normal to said central axis.

13. The tool of claim 1, wherein said tensioned element has an outer surface and said bore has an inner surface and wherein there is a clearance between said outer surface and said inner surface.

14. The tool of claim 1, wherein said tool is incorporated in at least one of a drill bit, a shear bit, a percussion bit, a roller cone bit, a mining pick, a trenching pick, an asphalt pick, an excavating pick, a mill, a hammermill, a cone crusher, a jaw crusher, and a shaft impactor.

15. The tool of claim 1, wherein said tensioned element is cold worked as tension is applied to said tensioned element.

16. A tool, comprising:

a head having a base end with a cavity formed therein, said cavity having an inward protruding catch forming an opening having a breadth, and said head having an impact surface opposite said base end;

a collar having a proximal end, a distal end, a central axis, and a bore extending from said proximate end to said distal end, said bore having a wall and a shoulder formed therein, and said proximate end being disposed proximate said base end of said head;

a tensioned element having a first end and a second end, said first end disposed within said cavity and said second end is at least partly secured within said bore, said tensioned element including a radially extending catch adapted to interlock within the cavity of said head; and an insert having a first breadth that is greater than said breadth of said opening, said insert being compressible to a breadth less than said breadth of said opening such that said insert may be passed through said opening of said cavity and return to said first breadth when in said cavity, said insert being disposed at least partly about said tensioned element.

* * * * *